US008469766B2

(12) United States Patent
Zheng

(10) Patent No.: US 8,469,766 B2
(45) Date of Patent: Jun. 25, 2013

(54) INTERACTIVE TOY SYSTEM

(75) Inventor: Yu Zheng, Walnut, CA (US)

(73) Assignee: Patent Category Corp., Walnut, CA (US)

( * ) Notice: Subject to any disclaimer, the term of this patent is extended or adjusted under 35 U.S.C. 154(b) by 1118 days.

(21) Appl. No.: 11/368,300

(22) Filed: Mar. 3, 2006

(65) Prior Publication Data

US 2007/0093172 A1 Apr. 26, 2007

Related U.S. Application Data

(63) Continuation-in-part of application No. 11/255,852, filed on Oct. 21, 2005, now abandoned.

(51) Int. Cl.
*A63H 3/00* (2006.01)

(52) U.S. Cl.
USPC ..... 446/268; 446/99; 446/175

(58) Field of Classification Search
USPC ..... 446/268, 99, 175; 463/30, 40, 47
See application file for complete search history.

(56) References Cited

U.S. PATENT DOCUMENTS

| | | | | |
|---|---|---|---|---|
| 4,712,184 | A | | 12/1987 | Haugerud |
| 4,770,416 | A | | 9/1988 | Shimizu et al. |
| 5,026,058 | A | | 6/1991 | Bromley |
| 5,212,368 | A | | 5/1993 | Hara |
| 5,271,627 | A | | 12/1993 | Russell et al. |
| D354,532 | S | | 1/1995 | Tornquist et al. |
| 5,379,461 | A | | 1/1995 | Wilmers |
| 5,411,259 | A | | 5/1995 | Pearson et al. |
| 5,429,363 | A | * | 7/1995 | Hayashi ..... 463/40 |
| 5,575,659 | A | | 11/1996 | King et al. |
| 5,607,336 | A | | 3/1997 | Lebensfeld et al. |
| 5,686,705 | A | | 11/1997 | Conroy et al. |
| 5,746,602 | A | | 5/1998 | Kikinis |
| 5,749,735 | A | | 5/1998 | Redford |
| 5,766,077 | A | * | 6/1998 | Hongo ..... 463/30 |
| 5,853,327 | A | | 12/1998 | Gilboa |
| 5,877,458 | A | | 3/1999 | Flowers |
| 6,012,961 | A | | 1/2000 | Sharpe, III et al. |
| 6,022,273 | A | | 2/2000 | Gabai |
| 6,056,618 | A | | 5/2000 | Larian |
| 6,086,478 | A | | 7/2000 | Klitsner et al. |

(Continued)

FOREIGN PATENT DOCUMENTS

| | | |
|---|---|---|
| EP | 1 486 237 | 12/2004 |
| GB | 2 275 207 A | 8/1994 |

(Continued)

OTHER PUBLICATIONS

ISR/Written Opinion from corresponding PCT/US08/057124—dated Jul. 29, 2008.

(Continued)

*Primary Examiner* — Tramar Harper
(74) *Attorney, Agent, or Firm* — Raymond Sun

(57) ABSTRACT

Systems and methods for interactive play are provided, including a method of interacting with an action figure. The method includes the steps of providing a base unit having a processor, providing an action figure having a memory which stores data relating to the action figure, communicating the data in the form of communication signals to the processor, and presenting an activity instruction based on the communication signals received, with the activity instruction enacting a real-life activity that the action figure can engage in.

5 Claims, 18 Drawing Sheets

U.S. PATENT DOCUMENTS

| | | | | |
|---|---|---|---|---|
| 6,110,000 | A | 8/2000 | Ting | |
| 6,135,845 | A | 10/2000 | Klimpert et al. | |
| 6,201,947 | B1 | 3/2001 | Hur | |
| 6,227,931 | B1 * | 5/2001 | Shackelford | 446/268 |
| 6,238,291 | B1 * | 5/2001 | Fujimoto et al. | 463/44 |
| 6,254,486 | B1 | 7/2001 | Mathieu et al. | |
| 6,290,565 | B1 * | 9/2001 | Galyean, III et al. | 446/99 |
| 6,290,566 | B1 | 9/2001 | Gabai et al. | |
| 6,319,010 | B1 | 11/2001 | Kikinis | |
| 6,319,087 | B1 | 11/2001 | Ferrigno | |
| 6,357,566 | B1 | 3/2002 | Pond | |
| 6,416,326 | B1 | 7/2002 | Oh | |
| 6,460,851 | B1 | 10/2002 | Lee et al. | |
| 6,471,565 | B2 * | 10/2002 | Simeray | 446/298 |
| 6,478,679 | B1 | 11/2002 | Himoto | |
| 6,497,606 | B2 | 12/2002 | Fong | |
| D470,540 | S | 2/2003 | Seelig et al. | |
| 6,546,436 | B1 | 4/2003 | Fainmesser et al. | |
| 6,554,679 | B1 | 4/2003 | Shackelford et al. | |
| 6,558,225 | B1 | 5/2003 | Rehkemper et al. | |
| 6,585,556 | B2 | 7/2003 | Smirnov | |
| 6,595,780 | B2 | 7/2003 | Singh et al. | |
| 6,612,501 | B1 | 9/2003 | Woll et al. | |
| RE38,286 | E | 10/2003 | Flowers | |
| 6,648,719 | B2 * | 11/2003 | Chan | 446/297 |
| 6,661,405 | B1 | 12/2003 | Flowers | |
| 6,663,393 | B1 | 12/2003 | Ghaly | |
| 6,668,156 | B2 | 12/2003 | Lynch et al. | |
| 6,704,028 | B2 | 3/2004 | Wugofski | |
| 6,719,604 | B2 | 4/2004 | Chan | |
| 6,728,776 | B1 | 4/2004 | Colbath | |
| 6,732,183 | B1 | 5/2004 | Graham | |
| 6,733,325 | B2 | 5/2004 | Sakai | |
| 6,758,678 | B2 | 7/2004 | Van Gilder et al. | |
| 6,761,637 | B2 | 7/2004 | Weston et al. | |
| 6,773,325 | B1 * | 8/2004 | Mawle et al. | 446/175 |
| 6,781,635 | B1 * | 8/2004 | Takeda | 348/552 |
| 6,801,815 | B1 | 10/2004 | Filo et al. | |
| 6,801,968 | B2 | 10/2004 | Hunter | |
| 6,811,491 | B1 | 11/2004 | Levenberg et al. | |
| 6,814,662 | B2 | 11/2004 | Sasaki et al. | |
| 6,814,667 | B2 | 11/2004 | Jeffway, Jr. et al. | |
| 6,877,096 | B1 | 4/2005 | Chung et al. | |
| 6,921,336 | B1 * | 7/2005 | Best | 463/32 |
| 6,949,003 | B2 | 9/2005 | Hornsby et al. | |
| 7,033,243 | B2 | 4/2006 | Hornsby et al. | |
| 7,035,583 | B2 | 4/2006 | Ferringno et al. | |
| 7,054,949 | B2 | 5/2006 | Jennings | |
| 7,073,191 | B2 | 7/2006 | Srikantan et al. | |
| 7,096,272 | B1 | 8/2006 | Raman | |
| 7,117,439 | B2 | 10/2006 | Barrett et al. | |
| 7,118,482 | B2 | 10/2006 | Ishihara et al. | |
| 7,120,653 | B2 | 10/2006 | Alfieri et al. | |
| 7,131,887 | B2 | 11/2006 | Hornsby et al. | |
| 2002/0028710 | A1 | 3/2002 | Ishihara et al. | |
| 2002/0061700 | A1 * | 5/2002 | Chan | 446/175 |
| 2002/0073084 | A1 | 6/2002 | Kauffman et al. | |
| 2002/0111808 | A1 | 8/2002 | Fienberg | |
| 2002/0125318 | A1 | 9/2002 | Tatsuta et al. | |
| 2002/0165028 | A1 * | 11/2002 | Miyamoto et al. | 463/46 |
| 2003/0148700 | A1 | 8/2003 | Arlinsky et al. | |
| 2003/0148705 | A1 * | 8/2003 | Chan | 446/484 |
| 2004/0043365 | A1 | 3/2004 | Kelley et al. | |
| 2004/0081110 | A1 | 4/2004 | Koskimies | |
| 2004/0087242 | A1 | 5/2004 | Hageman et al. | |
| 2004/0127140 | A1 | 7/2004 | Kelly et al. | |
| 2004/0191741 | A1 | 9/2004 | Ferringno et al. | |
| 2004/0197757 | A1 | 10/2004 | Musolf | |
| 2004/0203317 | A1 | 10/2004 | Small | |
| 2004/0214642 | A1 * | 10/2004 | Beck | 463/40 |
| 2004/0259465 | A1 | 12/2004 | Wright et al. | |
| 2005/0009610 | A1 | 1/2005 | Miyamoto et al. | |
| 2005/0048457 | A1 | 3/2005 | Ferringno et al. | |
| 2005/0216936 | A1 | 9/2005 | Knudson et al. | |

FOREIGN PATENT DOCUMENTS

| | | |
|---|---|---|
| KR | 10-2003-0057497 | 7/2003 |
| WO | WO 84/00503 | 2/1984 |
| WO | WO 99/64657 | 12/1999 |
| WO | WO 00/09229 | 2/2000 |
| WO | WO 0112285 A1 * | 2/2001 |
| WO | WO 01/97937 | 12/2001 |
| WO | WO 02/47013 | 6/2002 |
| WO | WO 2004/006197 | 1/2004 |
| WO | WO 2004/054123 | 6/2004 |

OTHER PUBLICATIONS

ISR/Written Opinion from corresponding PCT/US08/80621—dated Jul. 31, 2008.

Extended European Search Report dated Aug. 20, 2007 for corresponding EP Application No. 06021643.9.

ISR/Written Opinion from PCT/US07/79566 dated Sep. 15, 2008.

ISR/Written Opinion from PCT/US07/16549—Aug. 21, 2008.

* cited by examiner 20c
135c
22c
26c
70c
34c
38c
60c
36c
24c
46c
136c 20d
36d
22d
78d
60d
62d
60d
70d
24d
36d
26d
210
212
PC

INTERACTIVE TOY SYSTEM

BACKGROUND OF THE INVENTION

1. Related Cases

This is a continuation-in-part of Ser. No. 11/255,852, filed Oct. 21, 2005, now abandoned whose entire disclosure is incorporated by this reference as though set forth fully herein.

2. Field of the Invention

The present invention relates to toys, and in particular, to an interactive toy system.

3. Description of the Prior Art

Interactive toys have become increasingly popular in recent times. Children enjoy playing with toys that communicate or respond to different selections or prompts from the player. For example, U.S. Pat. No. 6,663,393 (Ghaly) U.S. Pat. No. 5,607,336 (Lebensfeld et al.), U.S. Pat. No. 6,648,719 (Chan) and U.S. Pat. No. 6,585,556 (Smirnov) all disclose toys, dolls or action figures who act or respond based on some activation by the user, or by the surrounding events.

SUMMARY OF THE DISCLOSURE

It is an object of the present invention to provide an interactive toy system which allows the user to enact real-life activities of a doll, animal, action-figure or similar creature.

It is another object of the present invention to provide an interactive toy system which provides a wide variety of responses and play.

It is yet another object of the present invention to provide an interactive toy system which provides different responses based on different selections made by the user.

In order to accomplish the objects of the present invention, the present invention provides systems and methods for interactive play, including a method of interacting with an action figure. The method of the present invention includes the steps of (i) providing a base unit having a processor, (ii) providing an action figure having a memory which stores data relating to the action figure, (iii) communicating the data in the form of communication signals to the processor, and (iv) presenting an activity instruction based on the communication signals received, with the activity instruction enacting a real-life activity that the action figure can engage in.

DETAILED DESCRIPTION OF THE PREFERRED EMBODIMENTS

The following detailed description is of the best presently contemplated modes of carrying out the invention. This description is not to be taken in a limiting sense, but is made merely for the purpose of illustrating general principles of embodiments of the invention. The scope of the invention is best defined by the appended claims.

As used herein, the term "doll" is not limited solely to a fashion doll or play doll, but encompasses figurines, action figures, toy animals, plush toys, miniature animals, or any miniaturized or toy version of any living creature.

The present invention provides an interactive toy system which allows the user to enact real-life activities of a doll, animal, action-figure or similar creature. More specifically, the present invention provides a toy system 20 which provides for interactive play between the system 20 and the user. The user can select different play programs which will program the doll or toy with certain emotions, responses or characters, and which will allow or direct the user to enact selected real-life activities for the doll or toy.

According to one embodiment of the present invention, the doll or toy merely functions as an object that is used by the player to enact selected real-life activities, and does not communicate or interact with the player. According to this embodiment, the player communicates solely with a base unit or doll station, which provides instructions or messages to the player regarding how the real-life activities are to be enacted. The player then utilizes the doll or toy to carry out the enactment. In this embodiment, the doll or toy may communicate interactively with the base unit or doll station, but will not communicate directly with the player.

Figure 1:
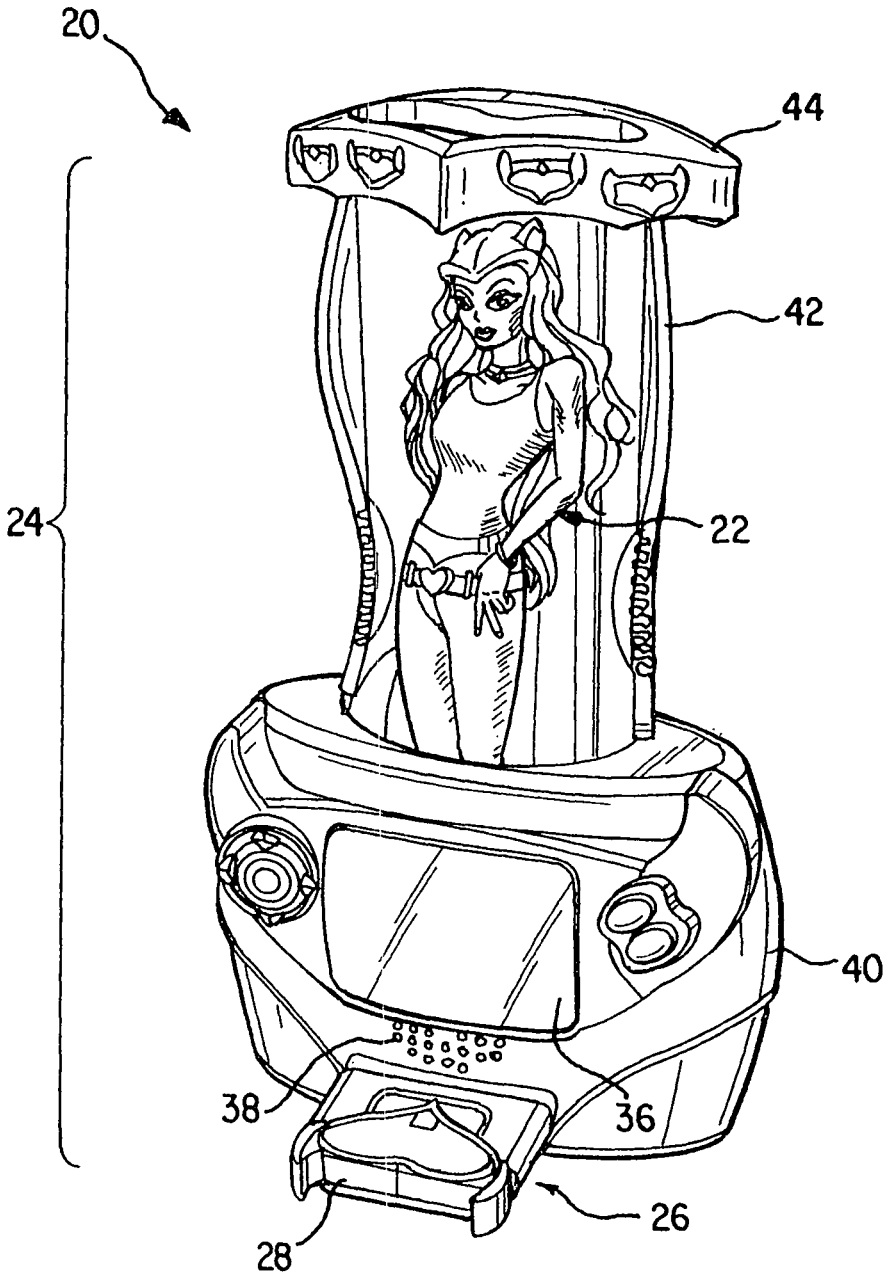
FIG. 1 is a perspective view of an interactive doll system according to one embodiment of the present invention with the doll shown positioned in the doll station.

FIG. 1 illustrates the basic components of an interactive doll system 20 according to one embodiment of the present invention. In its most basic form, the system 20 includes a doll 22, a doll station 24 and a storage device 26. However, as explained hereinbelow, the system 20 can also include a plurality of dolls 22, a plurality of doll stations 24, and a plurality of storage devices 26, all of which can be utilized to create a multi-variety interactive game system.

The storage device 26 can have a housing 28 that houses any conventional and well-known medium that includes a memory 30 (see FIG. 5) for storing digital data. The memory 30 can be embodied in the form of a memory card or cartridge or any other conventional storage medium, including a RAM, a ROM, or any writeable memory. The housing 28 can be ornamentally configured according to a given theme (e.g., princess theme) for the system, and can also include a communication (e.g., input/output) port 32 which is adapted to be removably coupled to a communication (e.g., input/output) port 34 at the doll station 24. The memory 30 can be adapted to store programs (software) for controlling the operation of the doll station 24, as described below. The memory 30 can also be adapted to store data that can be transferred to the doll station 24. Such data can include verbal or written messages, pre-recorded statements, sounds, music, light shows and other similar responses that can be displayed on the display screen 36 at the doll station 24, or emitted from the speaker 38 at the doll station 24. As used herein, the display screen 36 and the speaker 38 are mechanisms used by the system 20 to present a message. In addition, the system 20 can provide a plurality of different storage devices 26, with each storage device 26 storing software and/or data for different applications. For example, one storage device 26 can contain software and data directed to a princess doll application, another storage device 26 can contain software and data directed to a beach application, another storage device 26 can contain software and data directed to a party application, and another storage device 26 can contain software and data directed to a safari application, among others. The player can vary his/her play variety by selecting the desired storage device 26 for a desired application.

In addition, the storage device 26 can be coupled to a personal computer PC (see FIG. 5) to download new programs (either from the PC or from the Internet) that can be used to play the system 20. In this regard, the storage device 26 can be embodied in the form of a CD or other diskette.

Figure 3:
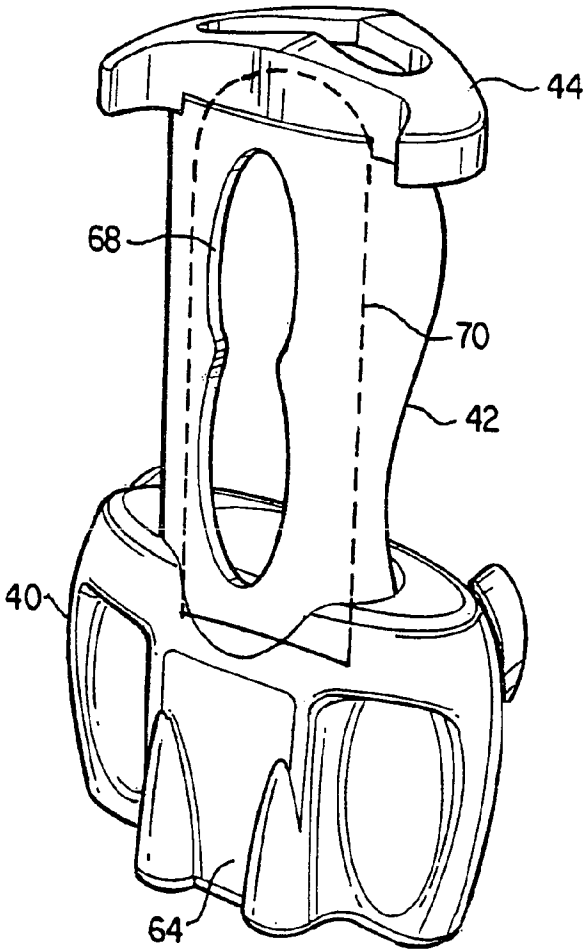
FIG. 3 is a rear perspective view of the doll station of the system of FIG. 1.
Figure 2:
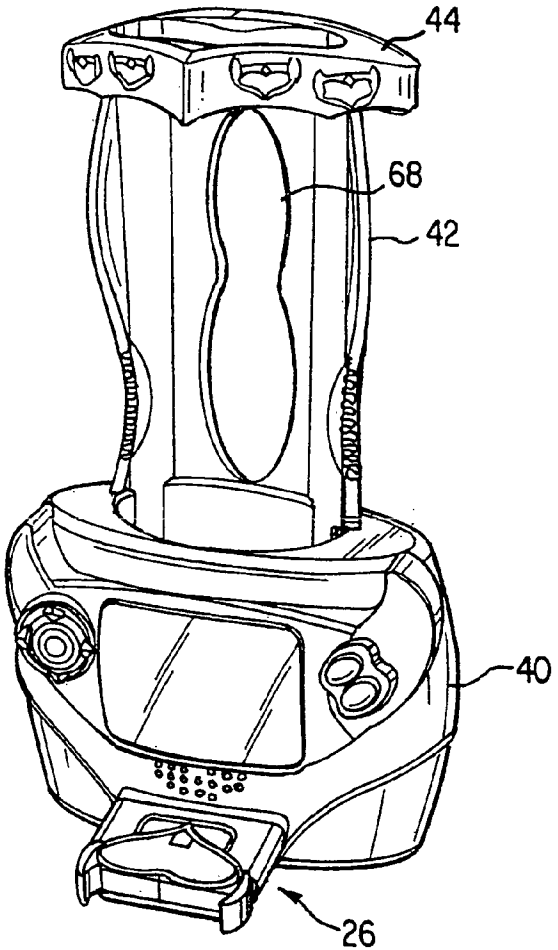
FIG. 2 is a front perspective view of the doll station of the system of FIG. 1.
Figure 4:
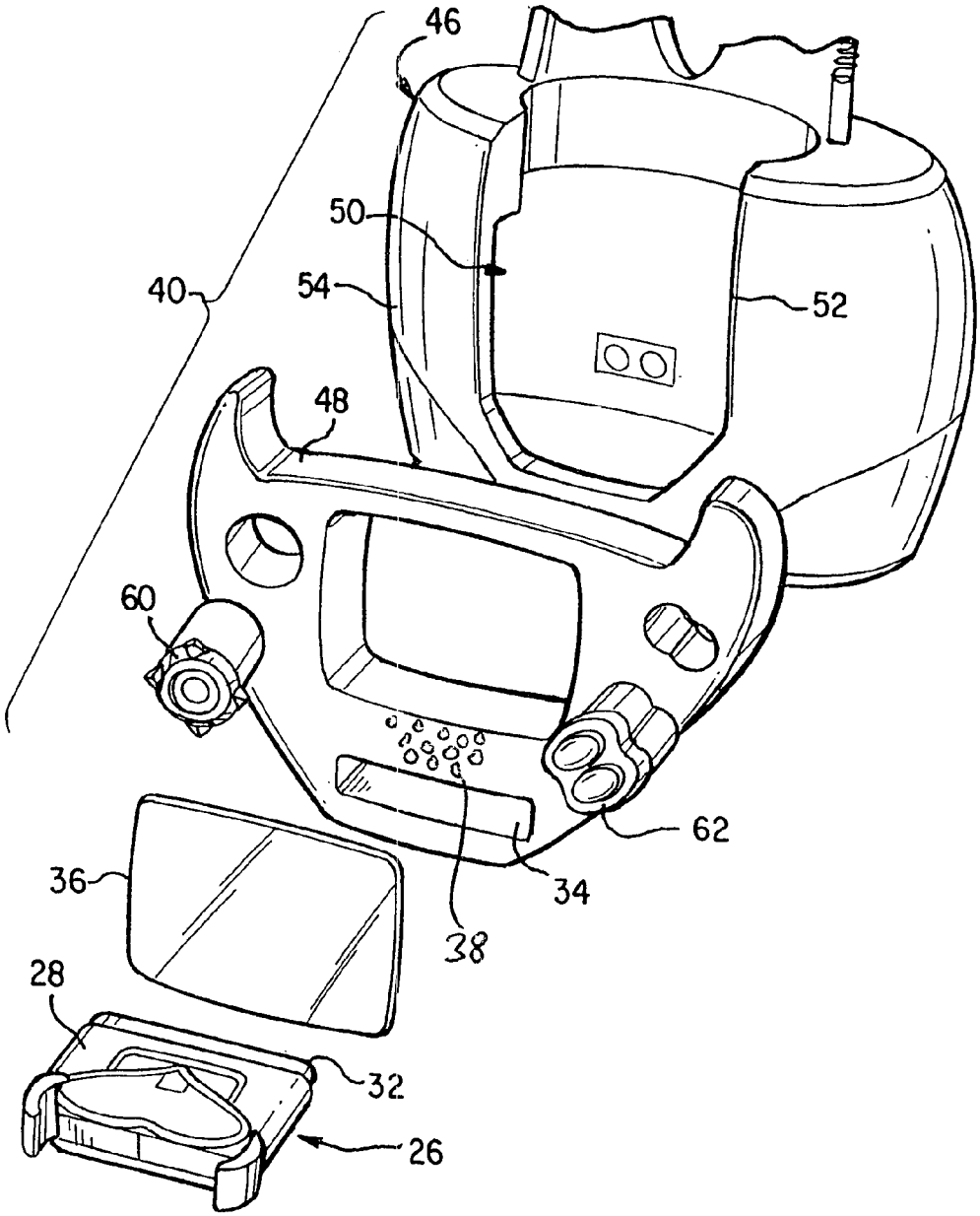
FIG. 4 is an exploded perspective view of the base of the doll station of FIG. 1.
Figure 5:
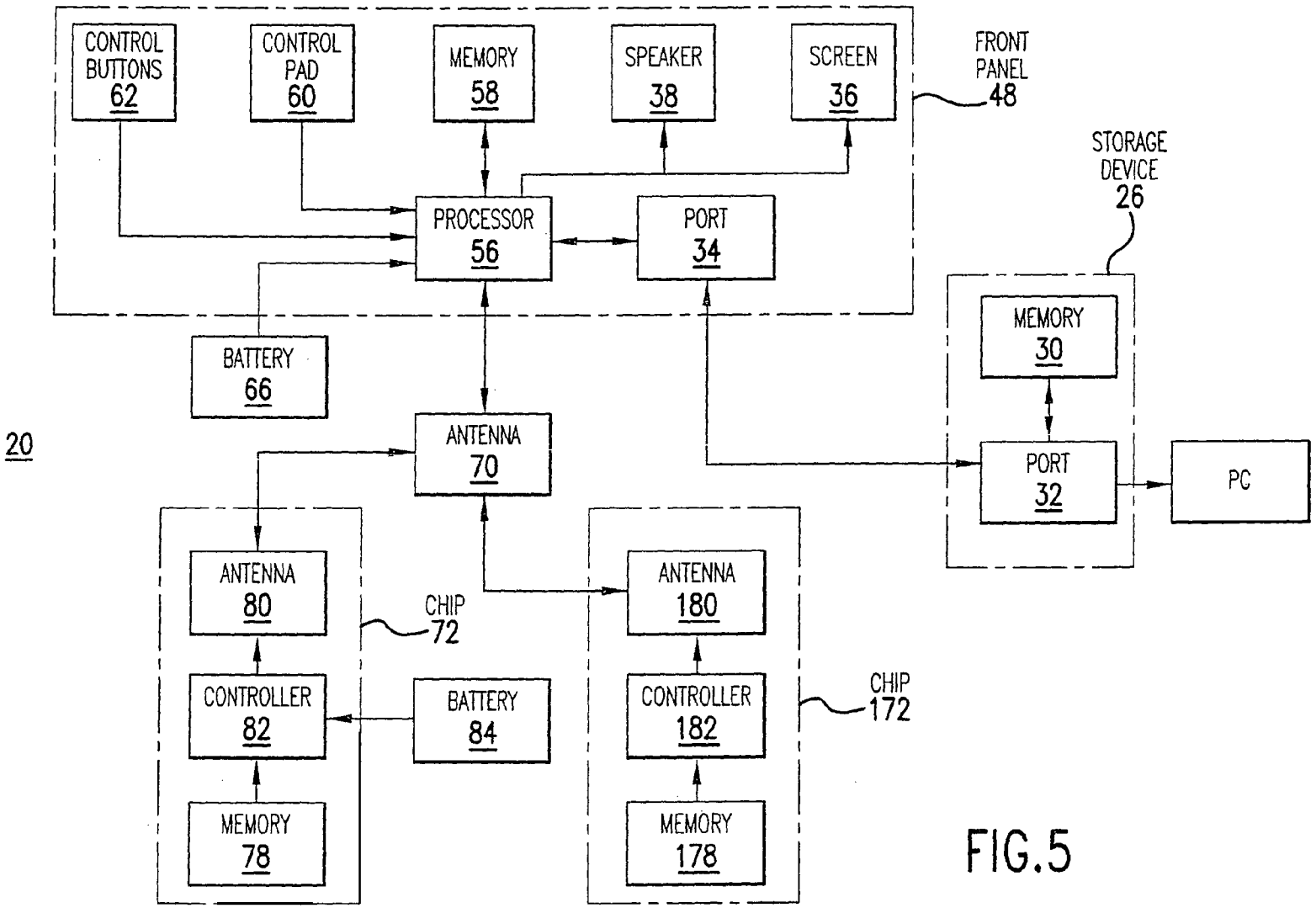
FIG. 5 is a block diagram illustrating the electrical components of the system of FIG. 1.

The doll station 24 is adapted to hold a doll 22 during use. Referring to FIGS. 2-3, the doll station 24 has a base 40, a rear wall 42, and a roof 44. Referring to FIG. 4, the base 40 has a base housing 46 and a front panel 48. The base housing 46 defines an interior space 50 for holding the doll 22, and has an opening 52 in its front wall 54 for receiving the front panel 48. The front panel 48 houses the electronics (see FIG. 5) of the doll station 24, which includes a processor 56 and a memory 58. The memory 58 can be used to store basic operating instructions for the processor 56, in which case the memory 58 can be embodied in the form of a ROM. Alternatively, the memory 58 can be used to store some or all of the programs, with the memory 30 on the storage device 26 used primarily for storing data that can be utilized to control or change the operation parameters of the programs stored in the memory 58. Referring to FIGS. 4 and 5, the communication port 34, the speaker 38 and the display screen 36 are provided on the front panel 48, and are all coupled to the processor 56. The front panel 48 can also include a control pad 60 and control buttons 62. The port 34 functions to allow data and instructions to be transferred from the memory 30 in the storage device 26 to the processor 56 in the front panel 48. The screen 36 functions to display words, images, colors, and patterns that are in response to instructions or data provided by the storage device 26 or the doll 22. The speaker 38 emits sounds to provide vocal instructions and music. The speaker 38 and the screen 36 are both controlled by the processor 56. The control pad 60 and the buttons 62 are coupled to the processor 56 to provide control signals to the processor 56, so that the player can control the operation of the system 20 by controlling the pad 60 and the buttons 62. For example, the player can press selected buttons 62, or control the pad 60, to select desired play modes or features, or to perform any of the play functions described hereinbelow.

Referring to FIG. 3, the base 40 can be provided with a battery compartment accessed by a battery cover 64. Conventional batteries 66 (see FIG. 5) can be housed inside the battery compartment, and coupled to the electronics to power the operation of the doll station 24.

The rear wall 42 extends from the top rear portion of the base 40, and is slightly curved to define a background wall for the doll 22. An optional window 68 can be provided in the rear wall 42 for ornamental or functional (e.g., provide access) purposes. In addition, an antenna 70 can be provided in the rear wall 42 (see FIG. 3), with the antenna 70 coupled to the electronics shown in FIG. 5 via wiring (not shown) that extends through the base housing 46 and the front panel 48.

The roof 44 is optional, and can be attached to the top of the rear wall 42 to provide a cover or shade for the doll 22 when the doll 22 is positioned inside the base 22. A handle (not shown) can be provided on top of the roof 44 to provide a means for the user to carry the doll station 24.

As shown in FIG. 1, the interior space 50 of the base 40 is adapted to hold a doll 22 with the doll 22 in the standing position. The doll 22 would be positioned in front of the rear wall 42, and below the roof 44. The user can insert the doll 22 into this interior space via the open front space defined by the roof 44, the base 40 and the rear wall 42. Even though the present embodiment illustrates the doll 22 as being positioned in a standing position, it is also possible to size and configure the base housing 46, the rear wall 42 and the roof 44 to accomodate the doll 22 in any desired position (sitting, standing, etc.).

Figure 6:
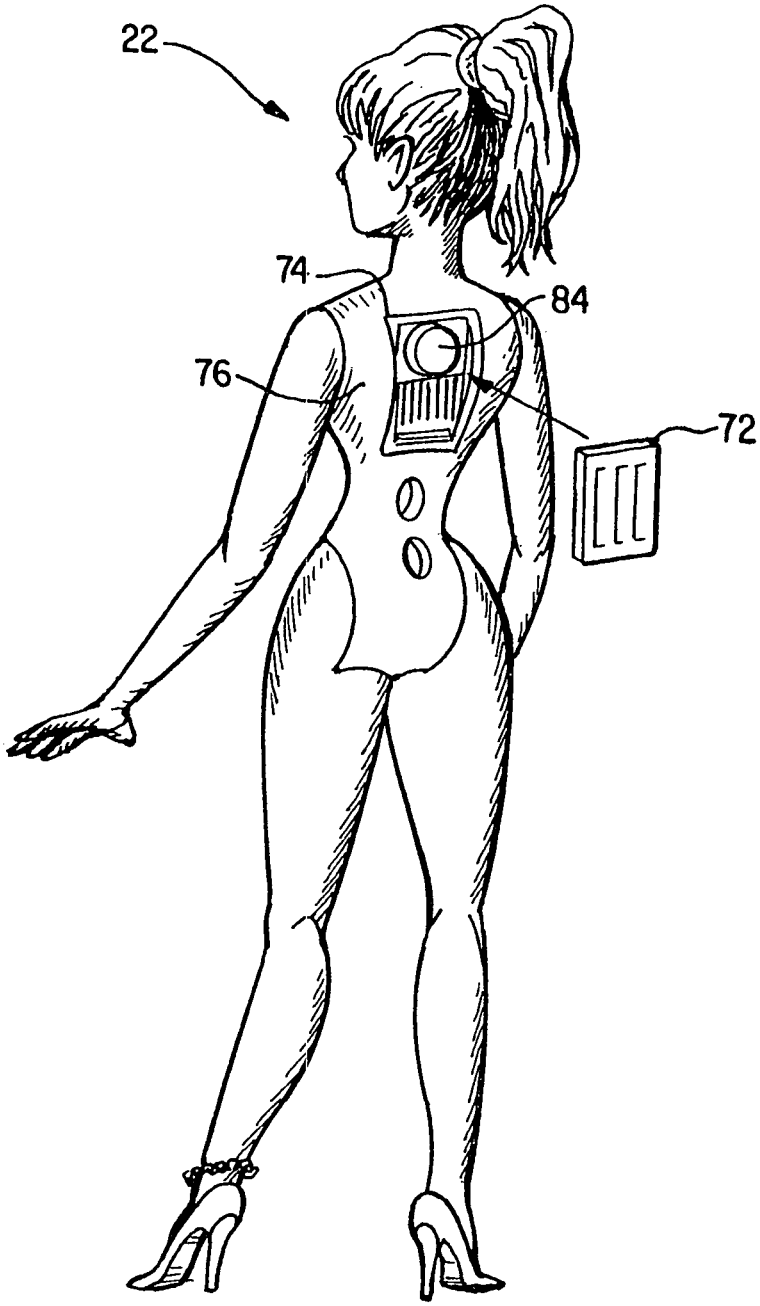
FIG. 6 is a rear perspective view of a doll according to one embodiment that can be used with the system of FIG. 1.

Referring to FIG. 6, the doll 22 is provided with a chip 72 that is secured in a slot 74 that is cut out from the torso 76 of the doll 22. Referring to FIG. 5, the chip 72 includes a memory 78 that is coupled to a controller 82 that is in turn coupled to an antenna 80. The antenna 80 is adapted to communicate with the electronics in the base 40 via the antenna 70 in the rear wall 42. In addition, a small battery 84 can be fitted into part of the slot 74 to power the chip 72. The battery 84 can be embodied in the form of a small watch battery. The memory 80 in the doll 22 contains data which identifies the doll 22 and certain characteristics of the doll 22. These characteristics can include the name, age, height, weight, size, likes, dislikes, mood, requests, type of voice (low-pitch, high-pitch, soft, loud, etc.), and any other characteristic (e.g., shy, outgoing, gregarious, etc.) that can be ascribed to a doll. Data corresponding to desired characteristics can be transferred from the memory 80 to the doll station 24 to activate different responses (e.g., verbal or written messages, pre-recorded statements, sounds, music, light shows, etc.) that can be displayed on the display screen 36 at the doll station 24, or emitted from the speaker 38 at the doll station 24. As a further alternative, the memory 78 in the chip 72 can even contain programs relating to different activities that the specific doll 22 can engage in, and these programs can be transferred to the processor 56 during operation.

When the doll 22 is placed inside the interior space 50 of the base 40, the antenna 70 and 80 will be positioned adjacent to each other, and be capable of communicating with each other. In one non-limiting embodiment of the present invention, the antenna 70 and 80 can be selected to be short-range antennas that can only communicate wireless signals over a short distance. The use of such short-range antenna would ensure that the doll 22 be positioned in, or in close proximity to, the base 40 before that particular doll 22 can be the subject of the activity. This can be an effective scheme if the manufacturer provides more than one type of doll 22, each having an antenna 80. If longer range antennas 70 and 80 were to be used for a multi-doll system 20, the antenna 70 at the base 40 could be receiving signals from multiple dolls 22, which might confuse the processor 56. Next, the characteristics of the doll 22 are transferred to the processor 56 at the doll station 24 (see step 102 below). In addition, as described below, the user can select a desired application by selecting one of a variety of storage devices 26.

Figure 7:
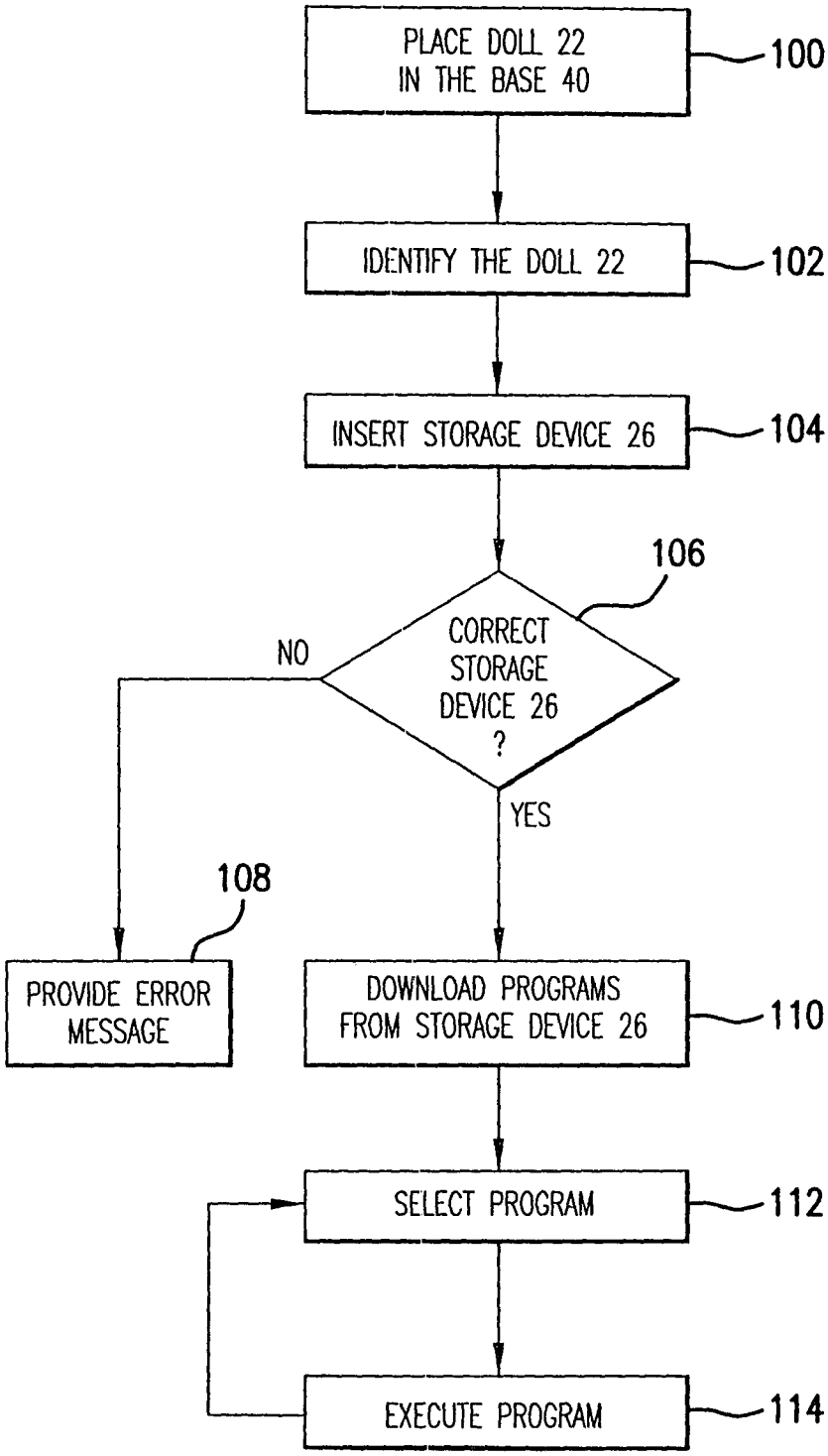
FIG. 7 is a flow chart illustrating one possible flow of operation for the system of the present invention.

FIG. 7 is a flowchart that illustrates one one-limiting example of an activity flow for the system 20. In a first step 100, the doll 22 is placed inside the interior space 50 of the base 40. In step 102, the processor 56 identifies the doll 22 in the manner described above, and receives the characteristics of the doll 22. For example, the system 20 can be provided with a plurality of different dolls 22 that can all be used with the same doll station 24. Thus, the identity of the doll 22 is determined in step 102. Next, in step 104, the player selects a storage device 26 and inserts it into the front panel 48. In step 106, the processor 48 identifies the selected storage device 26 (e.g., via signals from the memory 30 to the processor 56 that are communicated via the ports 32 and 34) and determines whether the selected storage device 26 can be used with the selected doll 22. For example, some of the storage devices 26 have applications that cannot be used with some of the dolls 22 in the system 20, and step 106 functions to determine whether the player has selected a compatible storage device 26 (i.e., application). If the selected storage device 26 is not compatible with the selected doll 22, the processor 48 will cause a message to be displayed on the screen 36, or announced through the speaker 38, in step 108, informing the player that an incompatible storage device 26 has been selected. If the selected storage device 26 is compatible with the selected doll 22, in step 110, the processor 48 will download the different software programs from the memory 30 in the storage device 26, and display the various choices in the form of a menu on the screen 36. Then, in step 112, the player can select the desired program for play, which is then executed in step 114. At the end of the execution of the selected program, processing returns to step 112 where the player can again select the next program for play.

Even though the flow of the present invention is described as including the use of a menu displaying various selections of programs, it is also possible to provide each storage device 26 with only one selection, so that a menu would be unnecessary.

A variety of different programs can be provided for selection by the player. All of these programs are adapted to allow the player to enact real-life activities for the doll 22, as if the doll 22 were alive and going through the normal daily activities of a living doll. These programs can be based on any of the following: (i) the characteristics of the doll 22 that have been downloaded from the memory 78 on the chip 72, (ii) the nature of the environment portrayed by the doll station 24, and (iii) the programs and/or theme of the selected storage device 26. These programs can also be independent of any of these parameters, and any of these parameters can be used together or independent of each other. It is the provision and selection of these parameters that allow the player to be able to enact the real-life activities of the doll 22. The following are a few non-limiting examples of programs (enacting activities) that can be stored in the memory 30 and/or 58 and/or 78 for play on the doll station 24.

EXAMPLE 1

The processor 56 causes the speaker 38 to emit an instruction, such as "I'm cold, please put a jacket on me". The player then goes to his/her doll accessories, takes a doll jacket and dresses the doll 22 with a jacket.

EXAMPLE 2

The processor 56 causes the speaker 38 to emit an instruction, such as "I would like to go to the beach". The player then takes the doll 22 out of the base 40 and takes the doll 22 to another doll station 24 that represents a beach environment, and inserts the doll 22 into the base 40 of the beach doll station 24. The steps outlined in FIG. 7 are then executed with respect to the beach doll station 24, and the play continues.

EXAMPLE 3

The processor 56 causes the speaker 38 to emit an instruction, such as "I would like to play with a friend". The player then takes a different (second) doll 22 and places it adjacent the doll station 24 so that the two dolls 22 can supposedly play with each other. The steps outlined in FIG. 7 are executed with respect to the second doll 22 and the station 24, and the play continues.

EXAMPLE 4

The processor 56 causes the screen 36 to display a colorful message, accompanied by music from the speaker 38. This performance can reflect the identity of the doll 22. For example, if the doll 22 is intended to be a happy doll, the screen 36 can be caused to display bright and colorful images, and the speaker 38 can broadcast cheerful music. On the other hand, if the doll 22 is intended to be an evil doll, the screen 36 can be caused to display malicious or dark images, and the speaker 38 can broadcast somber music. These performances can be used to reflect the attitude, character, emotions or mood of the doll 22.

EXAMPLE 5

Figure 8A:
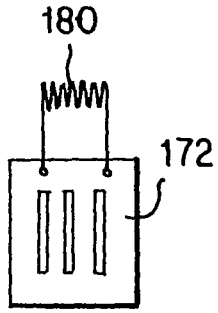
FIG. 8A illustrates a chip that can be used in connection with an accessory according to the present invention.
Figure 8B:
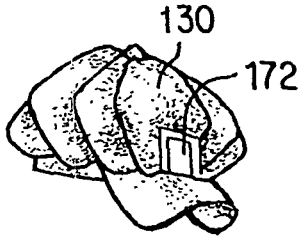
FIGS. 8B-8G illustrate various accessories that can be used with the system of the present invention.
Figure 8C:
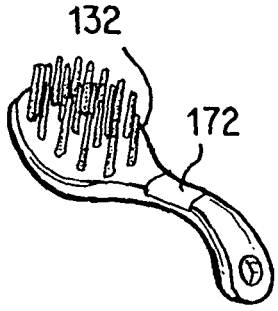
Figure 8D:
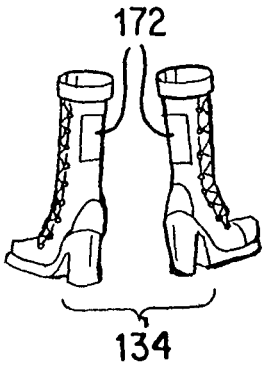
Figure 8F:
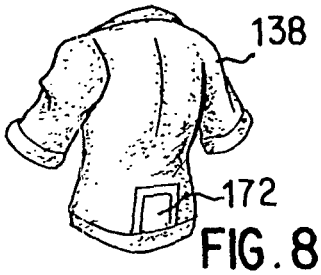
Figure 8E:
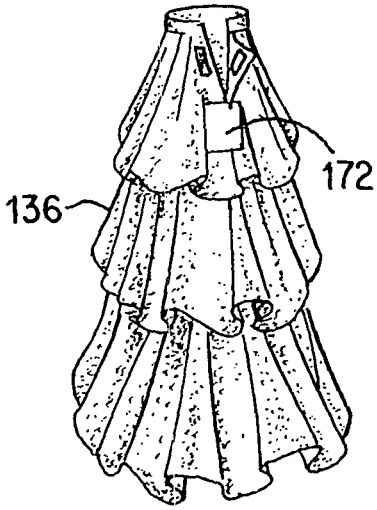

In one non-limiting embodiment of the present invention, the accessories that accompany the doll 22 can be provided with chips similar to chip 72 that allow for the accessory to communicate with the doll station 24. For example, FIGS. 5 and 8A illustrate a chip 172 that can be provided for use with an accessory. The chip 172 has an antenna 180 that is coupled to a memory 178 and a controller 182, which can be the same as the memory 78 and the controller 82, respectively. The antenna 180 allows the chip 172 to communicate with the processor 56 via the antenna 70. The memory 178 in the chip 172 stores data identifying the characteristics of the intended accessory. The antenna 180 can be the same as the antenna 80, and can be a short-range antenna.

Figure 8G:
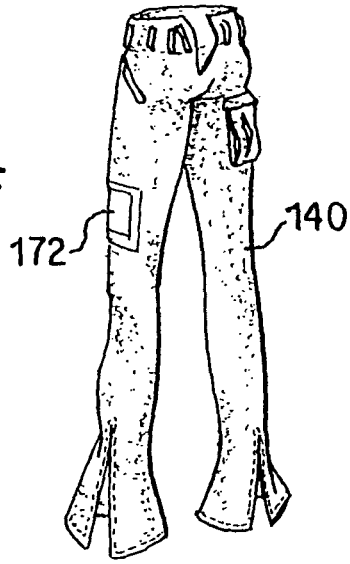

FIGS. 8B-8G illustrate various accessories that incorporate a chip 172, such as a hat 130 (FIG. 8B), a hair brush 132 (FIG. 8C), a pair of boots 134 (FIG. 8D), a skirt 136 (FIG. 8E), a blouse 138 (FIG. 8F), and a pair of trousers 140 (FIG. 8G). Any of these accessories can be used or carried by the doll 22. For example, the doll 22 could be wearing the blouse 138 when it is placed inside the base 40. The chip 172 on the blouse 138 would communicate with the processor 56 (via the antennas 70 and 180) to identify the blouse 138. If the blouse 138 is not the correct blouse 138 for the particular doll 22, the processor 56 can cause a message to be delivered (either via the speaker 38 and/or the screen 36) stating that "the blouse does not belong to this doll". As another example, if the program decides that the doll 22 is supposed to wear another article of clothing, the program can cause the processor 56 to deliver a message (via the speaker 38 and/or the screen 36) stating that "I do not like to wear this blouse; please dress me with another article of clothing". The same play examples can be provided for any accessory.

Alternatively, a program from any of the memories 30, 58, 78, or 178 can cause the speaker 38 or the screen 36 to emit an instruction, such as "Please give me my hair brush". The player then takes the hair brush 132 and places it in the doll's hand. The chip 172 on the hair brush 132 would communicate with the processor 56 (via the antennas 70 and 180) to identify the hair brush 132. If the player inadvertently places the wrong accessory (e.g., the hat 130) on the doll 22, the processor 56 can cause the speaker 38 and/or the screen 36 to emit a message informing the player that the wrong accessory has been chosen.

Figure 18:
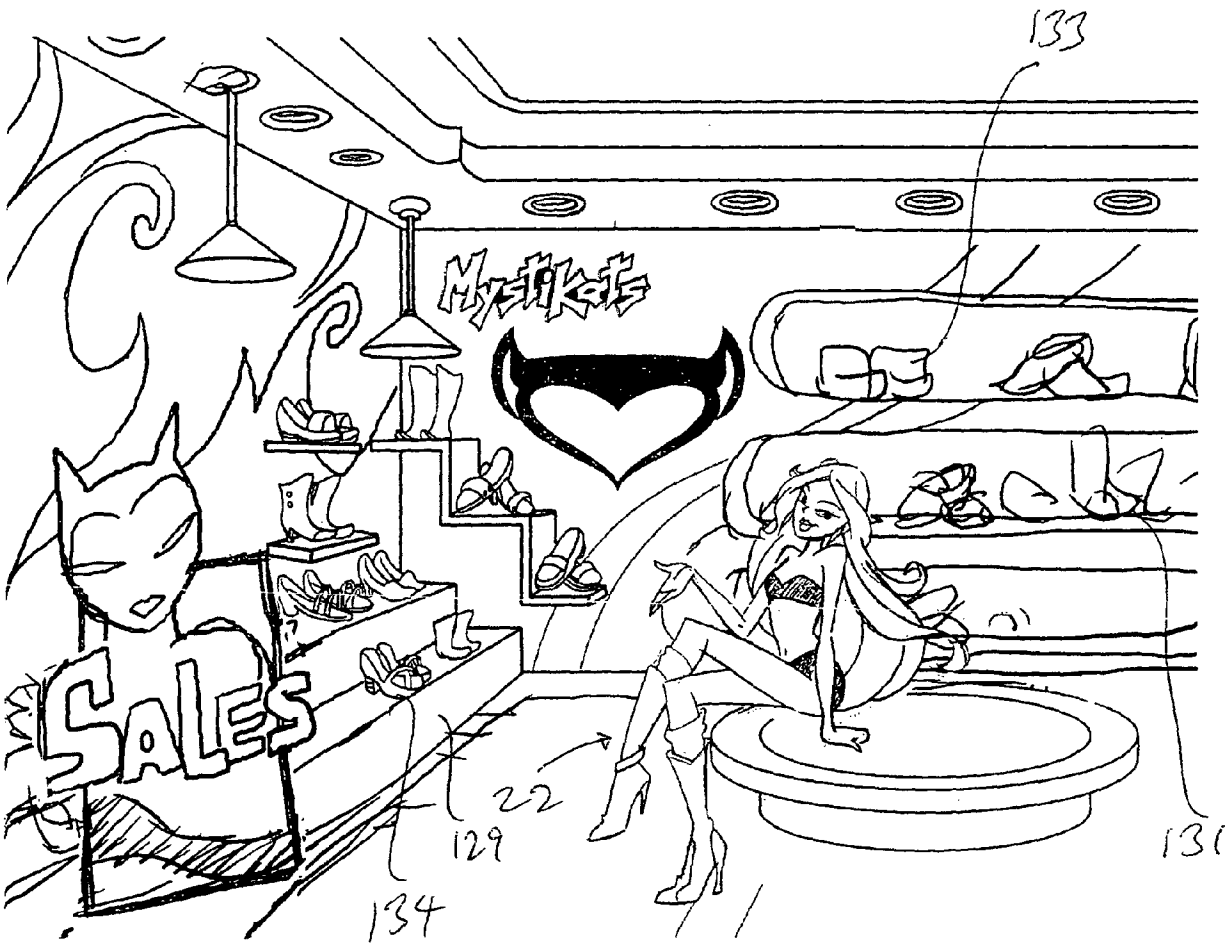
FIG. 18 illustrates an example of a play activity that can involve the incorporation of accessories.

FIG. 18 illustrates one non-limiting example of a play activity that can involve the incorporation of accessories. The image shown in FIG. 18 can be shown on the display screen 36 (or any of the display screens 36*c*, 36*d* described below). FIG. 18 is an image on the screen 36 that illustrates the doll 22 inside a fashion store that sells shoes 134 and handbags 133, as well as other accessories 131. These shoes 134 and handbags 133 are virtual representations of actual shoes 134 and handbags 133 that are supplied with the system 20. The player can then take a selected accessory (e.g., a pair of shoes 134) and dress or otherwise associate the actual doll 22 with the actual accessory. When the shoes 134 are worn by the doll 22, the controller 182 on the chip 172 of the shoes 134 will communicate with the processor 56 to identify the shoes 134 being worn. The processor 56 will then cause the screen 36 to change the image shown in FIG. 18 to show the selected shoes 134 being removed from the shelf 129 (the shelf 129 is a virtual shelf that only appears on the screen 36) and placed on to the feet of the virtual image of the doll 22 on the screen 36. When the player removes the shoes 134 from the feet of the actual doll 22, the image on the screen 36 will replicate that activity. The player can select another pair of shoes 134 to be worn by the actual doll 22, and the image on the screen 36 will again show the newly-selected shoes 134 being removed from the shelf 129 and placed on to the feet of the virtual image of the doll 22 on the screen 36.

EXAMPLE 6

The processor 56 causes the speaker 38 to emit an instruction, such as "I want to dance". The player then takes the doll 22 out of the base 40 and plays with the doll 22, pretending that the doll 22 is dancing. During this time, the speaker 38 can be broadcasting dance music, and the screen 36 can be displaying bright lights and other images.

EXAMPLE 7

The processor 56 can recognize and store information relating to the programs selected by the player, play patterns of the player, or anything related to the use and play of the system 20. This information can be transferred to the memory 30 in the storage device 26 via ports 34 and 32. The player can select such recognition and storage functions by manipulating the control buttons 62 and/or the control pad 60. The information in the memory 30 can then be transferred by the storage device 26 to a PC where the information can be analyzed, processed and stored for any desired purpose.

EXAMPLE 8

Figure 9:
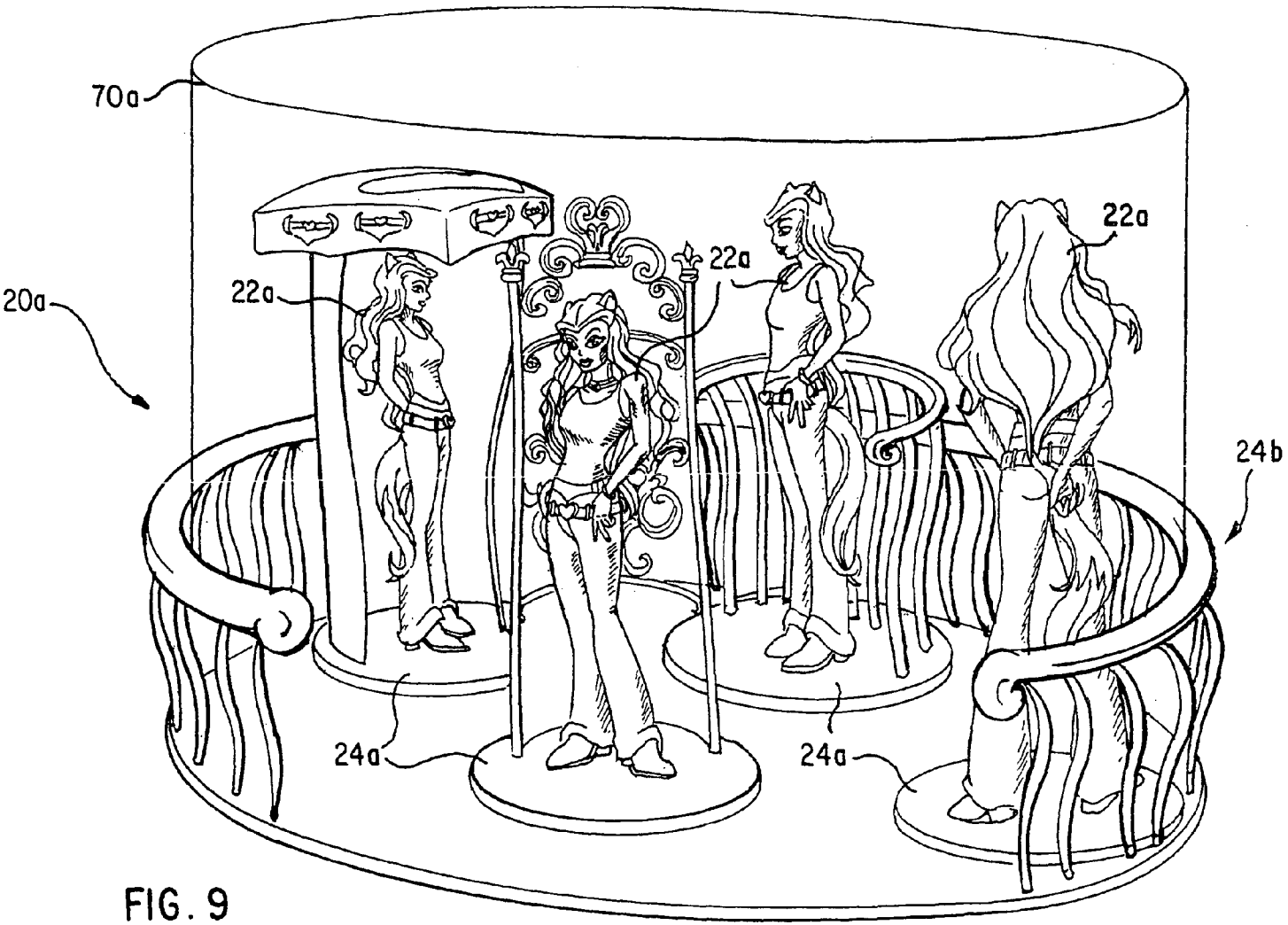
FIG. 9 is a perspective view of a multi-doll system that utilizes the principles of the present invention.

FIG. 9 illustrates the provision of a multi-doll system 20*a*, where a plurality of dolls 22*a* (each of which can be the same in construction as the doll 22) can be electrically coupled to a plurality of doll sub-stations 24*a* (each of which can be the same in principle as the base 40). The sub-stations 24*a* can be part of a larger doll station 24*b*. Each sub-station 24*a* can have its own antenna or communication device, but an additional antenna 70*a* (or communication device) can be provided to facilitate communication between the doll station 24*b* and any (or all) of the dolls 24*a*.

Figure 10A:
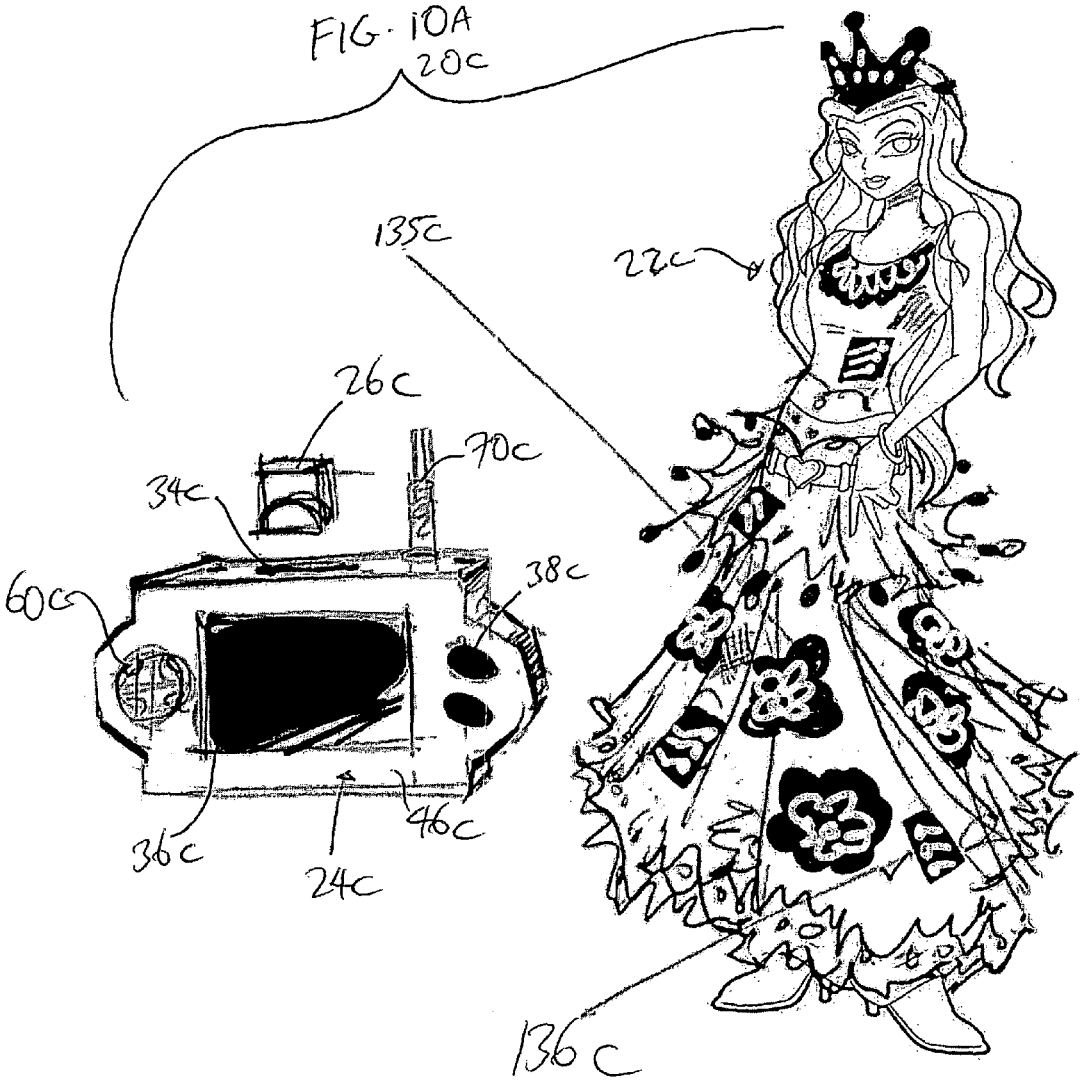
FIG. 10A is a perspective view of an interactive doll system according to another embodiment of the present invention.
Figure 10B:
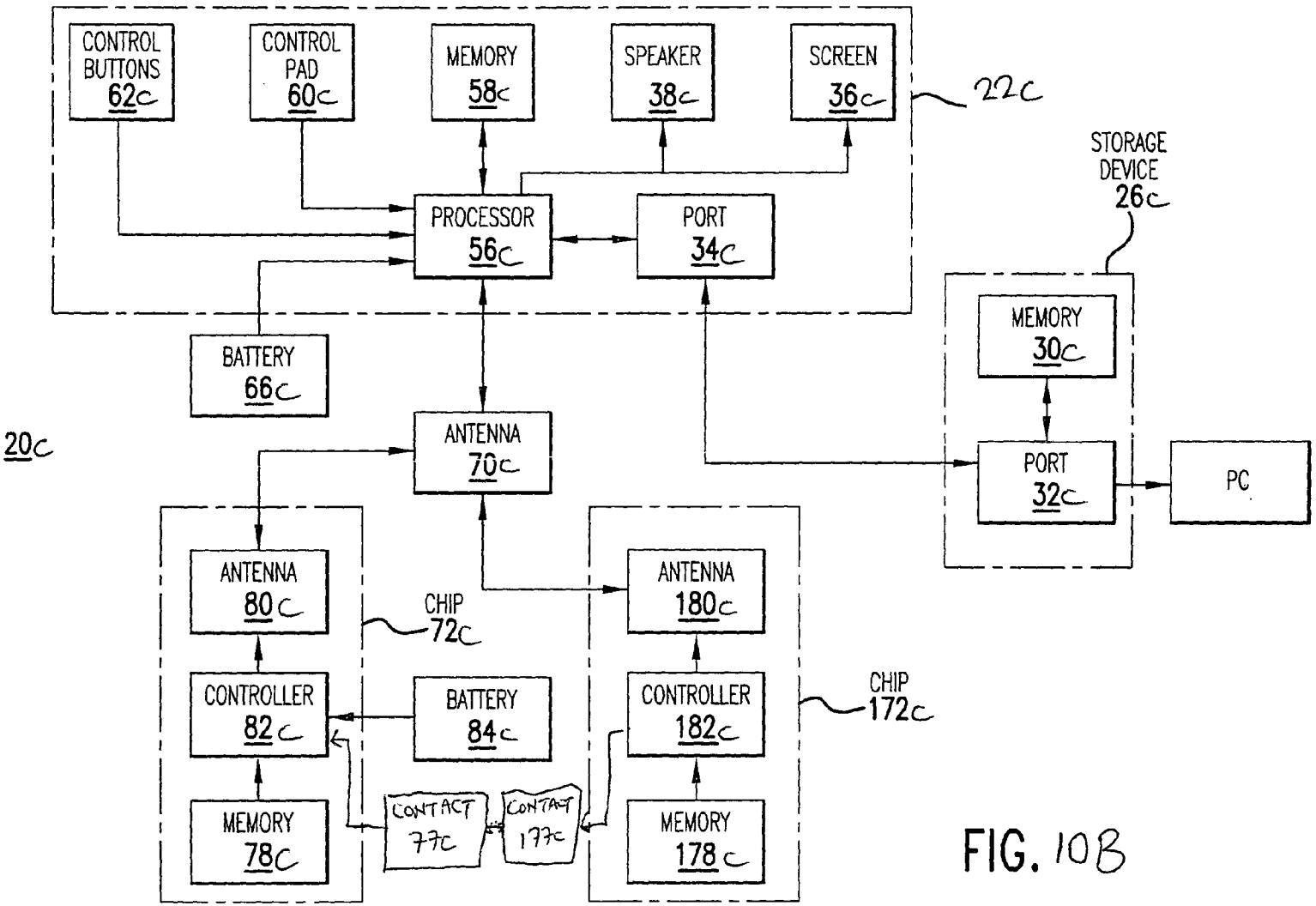
FIG. 10B is a block diagram illustrating the electrical components of the system of FIG. 10A.

FIGS. 10A-10B illustrate another embodiment of a system 20*c* under the present invention where the doll station 24 is now replaced by a hand-held base unit 24*c*. In particular, the doll 22*c* (which can be the same as the doll 22) does not need to be positioned inside or adjacent a doll station 24, but can instead be positioned as a stand-alone doll 22*c* without a base station 24. The base unit 24*c* can include all the functions and basic elements of the doll station 24. A separate storage device 26*c* (which can be the same as the storage device 26) can be inserted through a port 34*c* (which can be the same as the port 34) in the housing 46*c* of the base unit 24*c*. Similar to the doll station 24, the base unit 24*c* can also include a display screen 36*c*, speakers 38*c*, and a control pad 60*c* that can be the same as the corresponding elements in the doll station 24. An antenna 70*c* can be provided in the housing 46*c* of the base unit 24*c* for communicating with the antenna in the doll 22*c*.

The system 20*c* can operate in the same manner as the system 20, as described above. Specifically, the system 20*c* allows the player to enact real-life activities of the doll 22*c*, such as the activities described in Examples 1, 4, 5, 6 and 7 above. The system 20*c* can also implement the flowchart of FIG. 7.

Between the systems 20 and 20*c*, the system 20*c* may be better suited for use with a single doll 22*c*, so that the base unit 24*c* does not need to distinguish between signals received from a plurality of dolls 22*c* that are positioned in close-enough proximity to the base unit 24*c*. On the other hand, the system 20 may be better suited to use with a plurality of dolls 22 because the short-range antennas used in the system 20 will allow the doll station 24 to distinguish between the different dolls 22, since the antenna 70 in the doll station 24 will be adapted to communicate with the short-range antenna 80 in the doll 22 that is positioned inside the doll station 24.

The accessories used with the doll 22*c* can also include patches of conductive ink. For example, in FIG. 10, the dress 136*c* can be provided with patches of conductive ink 135*c* which can incorporate circuitry and even an antenna. Thus, the conductive ink 135*c* can be used in lieu of the chip 172 that is provided for the accessories in FIGS. 8B-8G.

FIG. 10B illustrates the electrical components of the system 20*c*, with the same elements in FIGS. 5 and 10B having the same numeral designations except that a "c" has been added to the designations in FIG. 10B. The systems shown in FIGS. 5 and 10B can be the same except that the system 20*c* in FIG. 10B can provide electrical contacts 77*c* and 177*c* on the doll 22*c* and the accessory (e.g., dress 136*c*), respectively. These contacts 77*c* and 177*c* can form an electrical coupling between the doll 22*c* and the accessory (e.g., dress 136*c*) so that the system 20*c* can accurately identify the specific accessory that has been used with the doll 22*c*. In particular, the controller 182*c* in the chip 172*c* of the dress 136*c* can communicate with the controller 82*c* in the base unit 24*c*, which can in turn communicate to the processor 56*c* the identity of the dress 136*c* that has been connected. These contacts 77*c*, 177*c* can be embodied using any of the concepts described in U.S. Pat. Nos. 6,648,719 and 6,719,604, whose entire disclosures are incorporated by this reference as though set forth fully herein.

Figure 11:
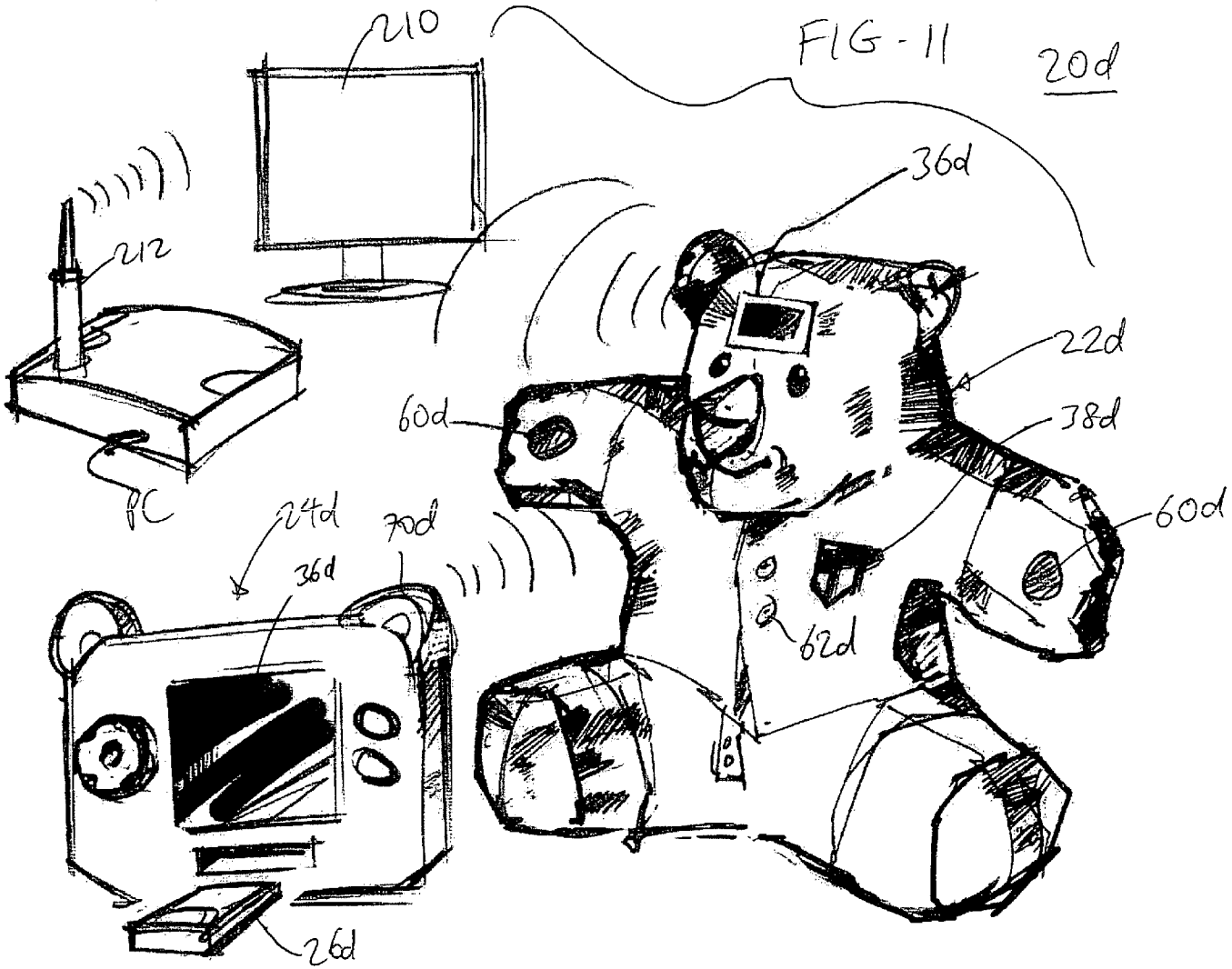
FIG. 11 is a perspective view of an interactive toy system according to another embodiment of the present invention.
Figure 12C:
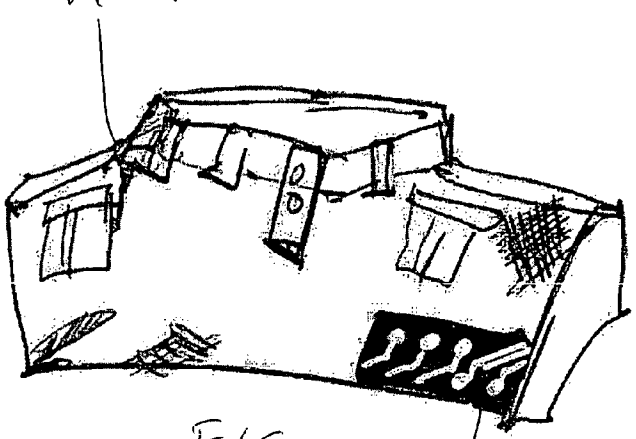
FIGS. 12A-12C illustrate various accessories that can be used with the toy system of FIG. 11.
Figure 12B:
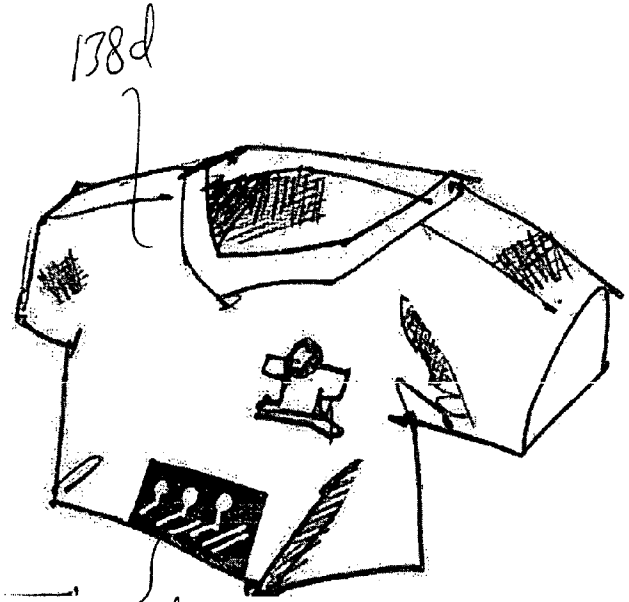
Figure 12A:
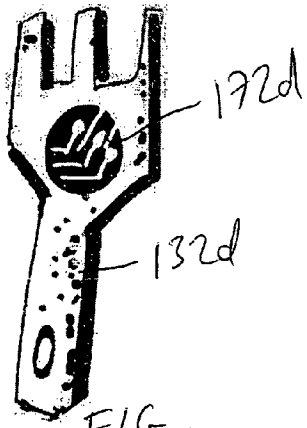

The principles of the present invention are not limited to action figures and fashion dolls only. FIGS. 11 and 12 illustrate another embodiment of a system 20*d* under the present invention where the doll 22*c* is now replaced by a teddy bear 22*d* or other toy animal. The system 20*d* also includes a base unit 24*d* that can be identical to the base unit 24*c*, and a storage device 26*d* that can be identical to storage devices 26*c* and 26. The teddy bear 22*d* can also include a chip (such as 72) and a battery (such as 84) to facilitate operation and use in the same manner as for the dolls 22 and 22*c* described above. Thus, a player can enact the same activities described above for the teddy bear 22*d*, including changing accessories and outfits. For example, the teddy bear 22*d* can be provided with accessories that incorporate a chip 172*d*, including a fork 132*d* (see FIG. 12A), a shirt 138*d* (see FIG. 12B), and a pair of trousers 140*d* (see FIG. 12C). These accessories are capable of communicating with the base unit 24*d* in the same way that the accessories in FIGS. 10A-10B are capable of communicating with the base unit 24*c*.

Figure 13:
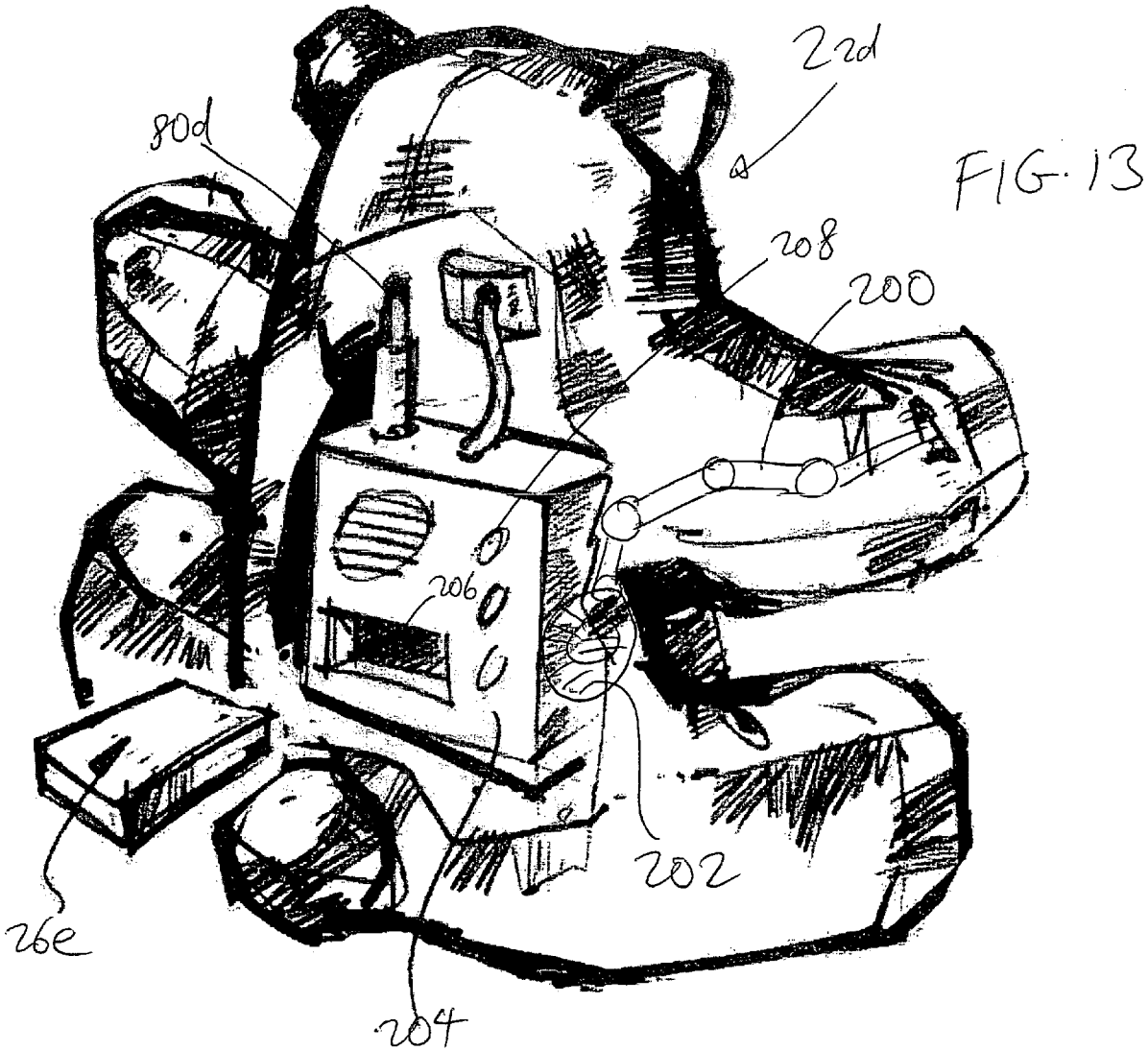
FIG. 13 illustrates modifications that can be made to the teddy bear in the system of FIG. 11.

In addition, as best shown in FIG. 13, the teddy bear 22*d* can be provided with pivotable appendages 200 that are pivotably connected to other appendages 200 to create movable limbs and body parts. These appendages 200 can be controlled by gears (e.g., 202) that are operatively connected to a servo motor (not shown) housed in a motor unit 204. The motor unit 204 can include a chip (not shown) that can be the same as the chip 72 in the doll 22, and can also include an antenna 80*d*. The motor unit 204 has a port 206 that can even receive another storage device 26*e*. The storage device 26*e* can contain different software which imparts different characteristics to the teddy bear 22*d*, and which can be used in addition to the software stored in the base unit 24*d* and the storage device 26*d* (i.e., that is used with the base unit 24*d*). For example, a plurality of different storage devices 26*e* can be provided, each designed to cause the teddy bear 22*d* to assume a different mood (e.g., happy, sad, angry, etc.) or character (e.g., quiet, gregarious, etc.) or motion (e.g., cause the appendages to move faster or slower, or to dance, or to walk, etc.). The player can select a specific storage device 26*e* depending on the mood, character and/or motion desired for the teddy bear 22*d*. The storage device 26*d* can then be used to enact a different activity for the teddy bear 22*d*, with the activity carried out based on the chosen mood, character and/or motion determined by the storage device 26*e*. Alternatively, the different moods, characters and/or motions can be programmed into the memory (not shown) inside the motor unit 204 (instead of providing a plurality of storage devices 26*e*), and selected by the player by actuating control buttons 208 on the motor unit 204.

Figure 14:
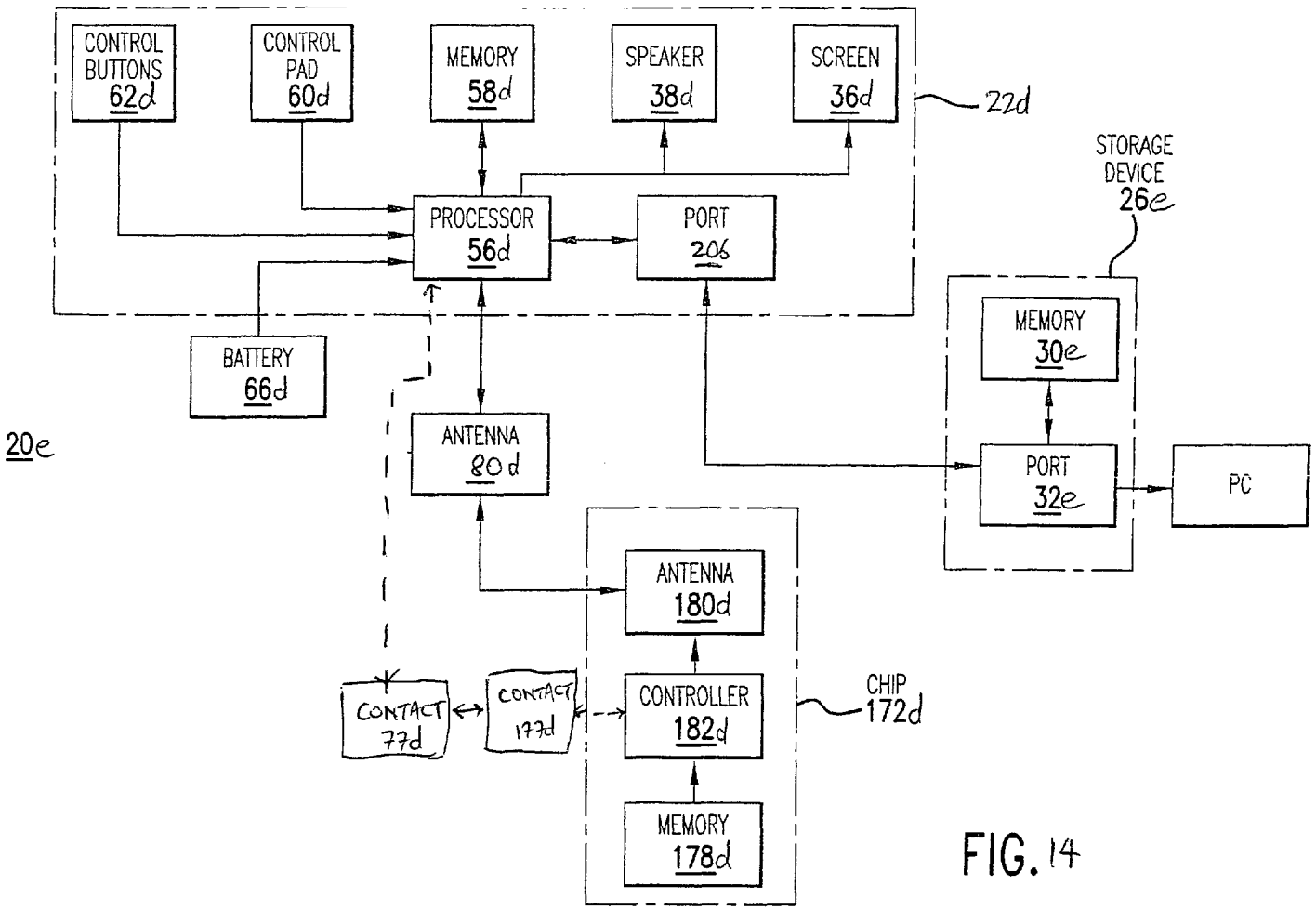
FIG. 14 is a block diagram illustrating the electrical components of the system of FIG. 13.

The teddy bear 22*d* in FIGS. 11 and 13 can even be modified to function as a base unit or station itself, so that the base unit 24*d* can be omitted and the elements of the base unit 24*d* can be provided as part of the teddy bear 22*d*. For example, a display screen 36*d*, a speaker 38*d*, a control pad 60*d* and control buttons 62*d* can be provided on the teddy bear 24*d*. In this embodiment 20*e*, the motor unit 204 can even house a battery 66*d*, a processor 56*d* and a memory 58*d* that are electrically coupled to the antenna 80*d*, the display screen 36*d*, the speaker 38*d* and the control buttons 62*d* and control pad 60*d* in the manner illustrated in FIG. 14. Thus, when FIG. 14 is compared with FIG. 5, these two systems 20 and 20*d* are essentially the same except that (i) the antenna 80*d* now functions as the antenna 70, (ii) the port 206 now functions as the port 34, (iii) the storage device(s) 26*e* now function as the storage device(s) 26 and 26*d*, and (iv) the chip 72 in FIG. 5 has been omitted. In addition, each chip 172*d* can include an antenna 180*d*, controller 182*d* and memory 178*d* that correspond to the antenna 180, controller 182 and memory 178 in FIGS. 1-5 and 8A-8G, and each storage device 26*e* can include a memory 30*e* and port 32*e* that correspond to the memory 30 and port 32 in FIGS. 1-5.

Instead of the wireless connection via the antennas 80*d* and 180*d*, as an alternative, electrical contacts 77*d* and 177*d* can be provided on the teddy bear 22*d* and the accessory (e.g., shirt 138*d*), respectively. Referring to FIG. 14, these contacts 77*d* and 177*d* can form an electrical coupling between the teddy bear 22*d* and the accessory (e.g., shirt 138*d*) so that the system 20*d* can accurately identify the specific accessory that has been used with the teddy bear 22*d*. In particular, the controller 182*d* in the chip 172*d* of the shirt 138*d* can communicate with the processor 56*d* in the teddy bear 22*d*, thereby indicating to the processor 56*d* the identity of the shirt 138*d* that has been connected.

The system 20*d* can even be modified to include a PC and a PC monitor 210. The antenna 70*d* on the base unit 24*d* can communicate signals with the antenna 212 on the PC or other computer, and the images displayed on the screen 38*d* can be replicated on the monitor 210. The PC can even be used to store programs, and to transfer programs to the base unit 24*d* for execution thereat.

Figure 15:
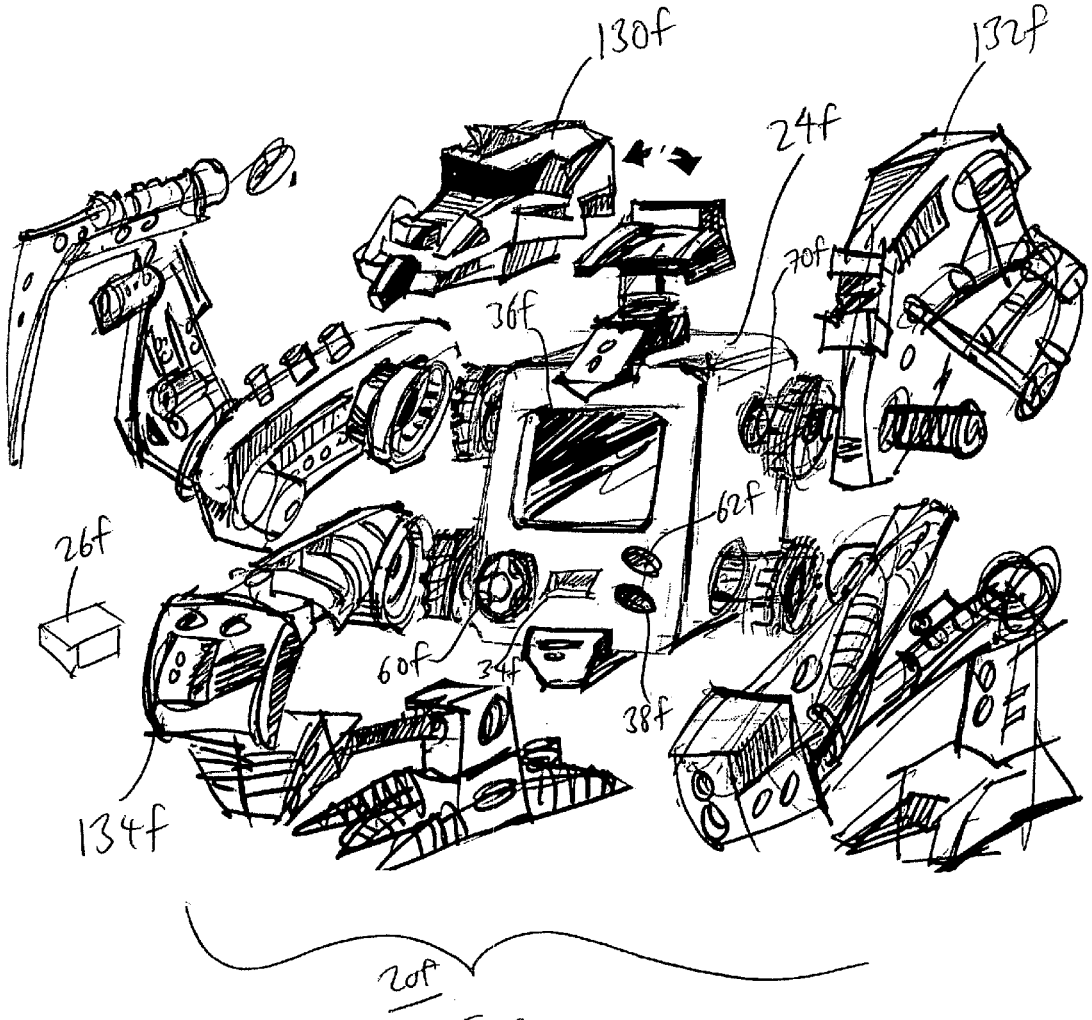
FIG. 15 is an exploded perspective view of a toy system according to yet another embodiment of the present invention.
Figure 16:
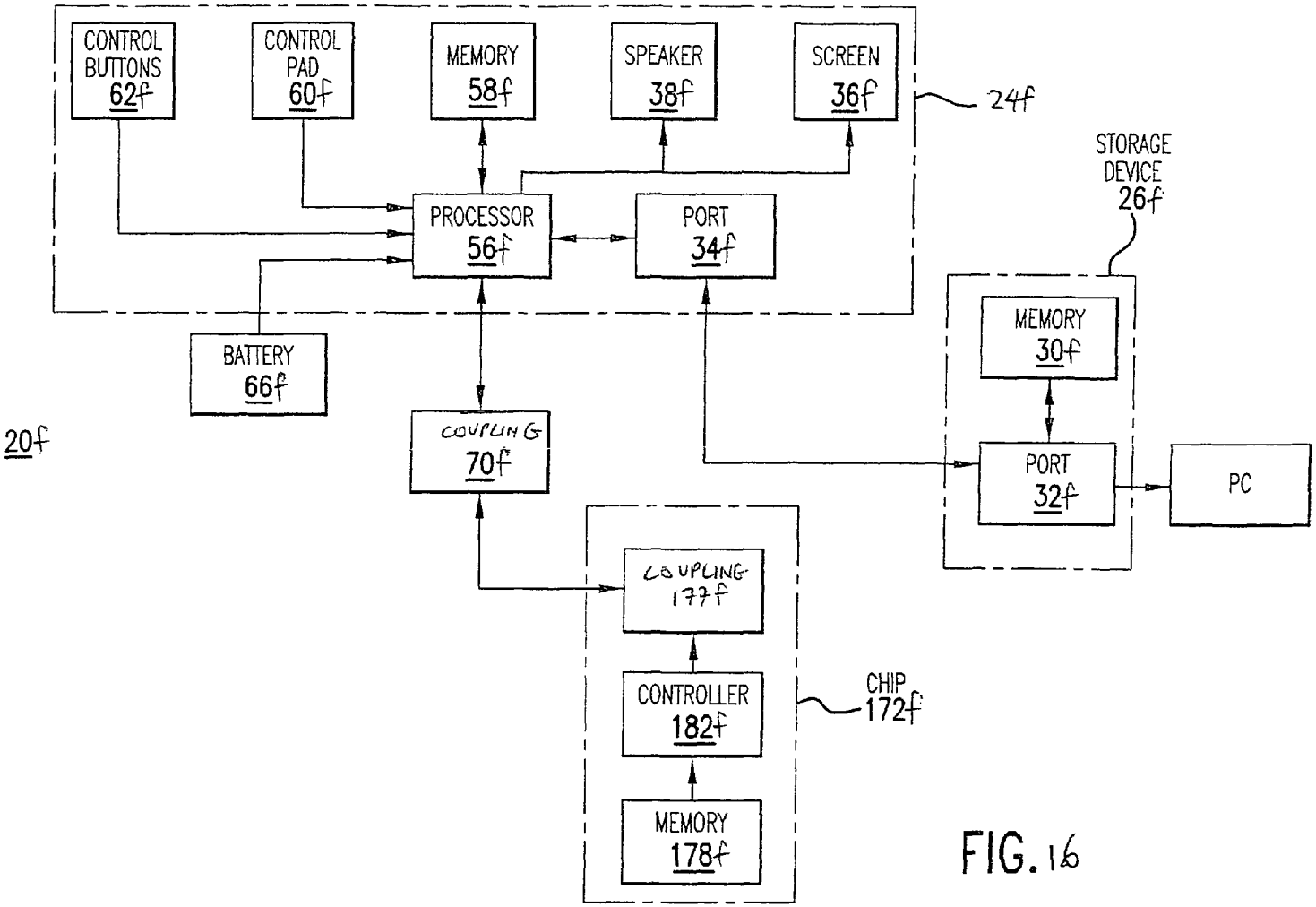
FIG. 16 is a block diagram illustrating the electrical components of the system of FIG. 15.

The principles in FIGS. 11 and 13-14 can be further extended to provide an interactive constructional or building system. FIGS. 15-16 illustrate a constructional system 20*f* having a base unit 24*f* that can be similar to the teddy bear 22*d* in the embodiment 20*e* of FIG. 14 where the teddy bear 22*d* is itself a base unit. In this embodiment, the base unit 24*f* forms a basic building block upon which other pieces 130*f*, 132*f*, 134*f* can be connected or assembled to form different resulting objects.

The base unit 24*f* can include all of the elements of the base station 24, including a battery 66*f*, a processor 56*f*, a memory 58*f*, a screen 36*f*, a speaker 38*f*, a control pad 60*f*, a control button 62*f* and a port 34*f* that can be the same as the corresponding elements in FIGS. 1-5. The base unit 24*f* can also include an electrical coupling 70*f* for receiving a piece 130*f*, 132*f*, 134*f*, etc. The coupling 70*f* can be similar to the contacts 77*c* and 77*d* described above. The storage device 26*f* can include all of the elements of the storage device 26, including a memory 30*f* and a port 32*f*. In addition, each of the pieces 130*f*, 132*f*, 134*f* can correspond to different accessories 130, 132, 134, etc., in FIGS. 8B-8G, and in this embodiment can represent a head 130*f*, an arm 132*f* and a leg 134*f*. Each of these pieces 130*f*, 132*f*, 134*f* can also include a chip 172*f* that can be the same as the chip 172, and include the corresponding coupling 177*f* (which can be the same as the coupling 177*c* and 177*d* described above), controller 182*f* and memory 178*f*.

The base unit 24*f* can include software that is adapted to recognize the various pieces 130*f*, 132*f*, 134*f*, etc. In addition, each different storage device 26*f* can include software for guiding the player in constructing a particular object. For example, the memory 30*f* in a specific storage device 26*f* can contain software for guiding the player in constructing a dinosaur, and the memory 30*f* in another storage device 26*f* can contain software for guiding the player in constructing a bird. Alternatively, the storage device 26*f* can be omitted, and the memory 58*f* in the base unit 24*f* can store the different software that can be selected by the player for guiding the player in constructing the different objects.

Figure 17:
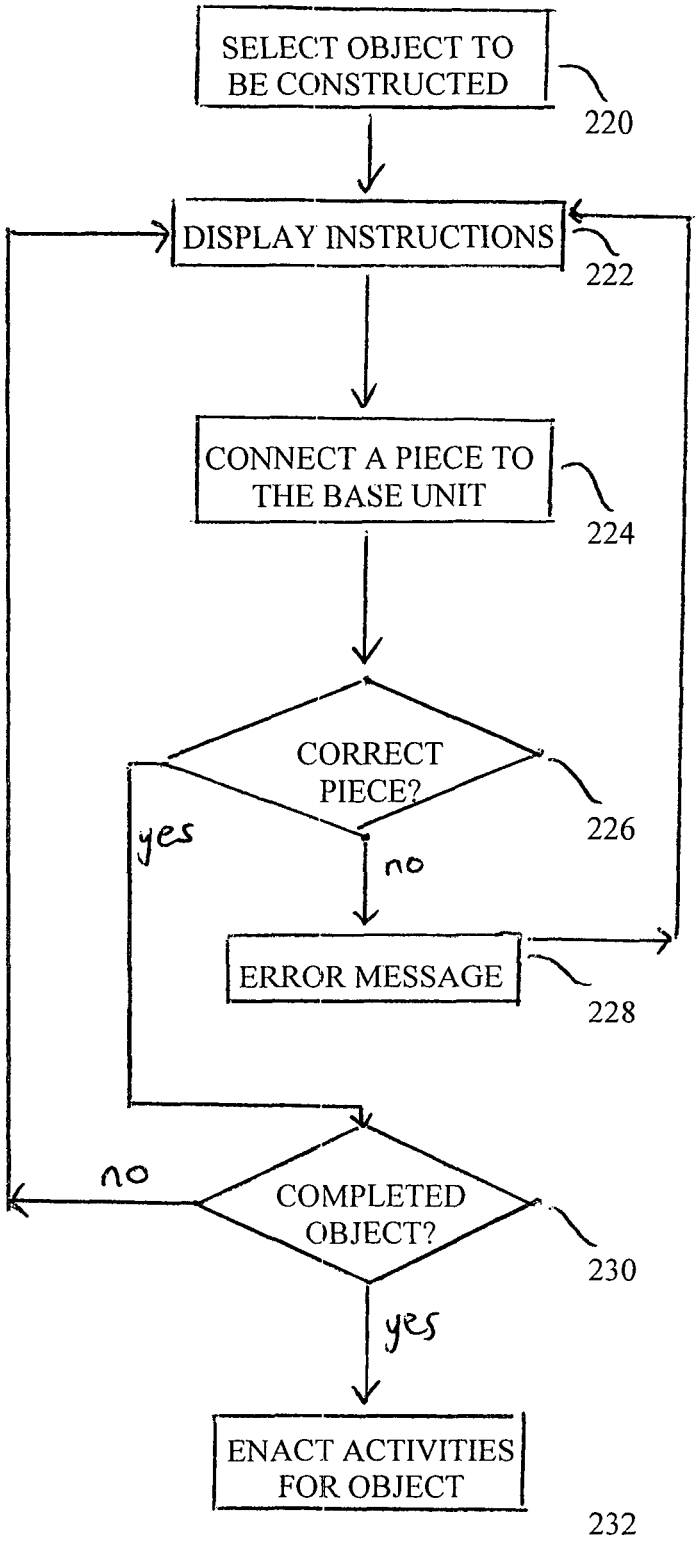
FIG. 17 is a flow chart illustrating one possible flow of operation for the system of FIGS. 15-16.

One possible use of the toy system 20*f* is illustrated in the flowchart of FIG. 17, which is educational in nature. In step 220, the player first selects the object to be constructed. This can be accomplished by selecting a software that has been stored in the memory 58*f*, or by selecting the desired storage device 26*f* and inserting the selected storage device 26*f* into the port 34*f*. Next, in step 222, the selected software will cause instructions or images to appear on the screen 36*f* and/or through the speaker 38*f* illustrating the next piece (e.g., arm 132*f*) that needs to be connected to the base unit 24*f*. In step 224, the player connects the coupling 177*f* of the arm 132*f* to the appropriate coupling 70*f*. The coupling 70*f* is an electrical coupling (e.g., an electrical contact) that allows the controller 182*f* in the chip 172*f* of the arm 132*f* to communicate with the processor 56*f* in the base unit 24*f*, thereby indicating to the processor 56*f* the identity of the piece that has been connected. In step 226, the processor 56*f* checks to see if the correct piece has been connected. If yes, then processing proceeds to step 230 to determine if the object has been completed. If the object has not been completed, processing returns to step 222 to issue the next instructions or images for connecting the next piece. If at step 226 it is determined that the incorrect piece has been connected, processing proceeds to step 228 where an error message is displayed (on the screen 36*f*) and/or broadcast (over the speaker 38*f*). Processing then returns to step 222 where the same instruction or image is displayed or broadcast again. This continues until the desired object has been completed at step 230. The flowchart of FIG. 17 can also include an alternative step 232 where the player can use the completed object in the same manner as the teddy bear 22*d* to enact real-life activities for the completed object, according to the principles described above.

The toy system 20*f* can be used to generate a variety of different activities. According to a second activity, the memory 30*f* in the storage device 26*f* or the memory 58*f* in the base unit 24*f* can store software and a database relating to the construction of different objects. This activity allows the player to initiate the construction and then gives the player choices as to what object(s) the player can assemble based on the start initiated by the player. Thus, this activity is more creative and interactive in nature. For example, in a first step, the player connects a piece (e.g., the arm 132*f*) to any coupling (e.g., 70*f*) in the base unit 24*f*. Then, in the next step, the software will determine the different objects that can be constructed based on the initial first connection, and will display the options to the player on the screen 36*f*, including instructions for assembling each option. The player can continue to connect additional pieces, and as each additional piece is connected, the software will update its identification of the connected pieces from its database, and cause the screen 36*f* at the base unit 24*f* to display new and updated options for the player. This process continues until an object is completely assembled, and even at that point, the player can continue to connect additional pieces, while the software will continue to search its database for possible new objects that can be built. This activity allows the player to engage in either (i) a challenging and creative interactive building game where the player attempts to outwit the system 20*f* in building an object, or (ii) an instructional interactive game where the system 20*f* can guide the player in building one of many different objects.

While the description above refers to particular embodiments of the present invention, it will be understood that many modifications may be made without departing from the spirit thereof. The accompanying claims are intended to cover such modifications as would fall within the true scope and spirit of the present invention.

As a non-limiting example, even though the present invention illustrates the use of antennas to facilitate communication between the doll station 24 and the doll 22 and accessories, its also possible to use wires and other known electrical couplings to facilitate such communication. Also, the wired communication between the ports 32 and 34 can be replaced by wireless communication utilizing separate antennas at the locations of the ports 32 and 34.

What is claimed is:

1. A method of interacting with an action figure, comprising:

a. providing a hand-held unit having a processor, a screen, an antenna, and control buttons, the hand-held unit sized to fit completely within the two hands of a human being;

b. providing an action figure having an action figure memory which stores action figure data relating to the action figure;

c. providing an accessory associated with the action figure, the accessory having an accessory memory which stores accessory data relating to the accessory, the accessory data including characteristics of the accessory that are in addition to the identification of the accessory, the accessory memory including a program that contains instructions relating to an activity;

d. coupling the hand-held unit to an external computer and an external monitor;

e. the action figure communicating the action figure data in the form of first communication signals to the processor;

f. the accessory communicating the accessory data in the form of second communication signals to the processor, as well as providing program instructions from the accessory memory to the processor;

g. the hand-held unit presenting an activity instruction that is based on the first and second communication signals and the accessory data received;

h. the processor verifying whether the accessory is the correct accessory designated by the activity instruction;

i. the monitor displaying the activity instruction; and j. a user enacting a real-life activity with the action figure based on the activity instruction.

2. The method of claim 1, further including:

providing the hand-held unit with a storage device having a memory which stores instruction data;

communicating the instruction data in the form of instruction signals to the processor; and presenting the activity instruction based on the communication signals and instruction signals received.

3. The method of claim 1, further including:

e. transmitting a control signal to the action figure to cause the action figure to experience movement.

4. The method of claim 1, further including:

presenting the activity instruction from the screen of the hand-held unit.

5. The method of claim 1, further comprising:

displaying images from the screen on the monitor.

* * * * *